US008973782B2

(12) United States Patent
Klier et al.

(10) Patent No.: US 8,973,782 B2
(45) Date of Patent: Mar. 10, 2015

(54) APPARATUS FOR DISPENSING ELONGATED ARTICLES

(75) Inventors: Niri Klier, Savyon (IL); Shai Gal, Tel Katzir (IL); Yarom Goren, Savyon (IL)

(73) Assignee: Nice Vend Ltd., Petach Tikva (IL)

( * ) Notice: Subject to any disclaimer, the term of this patent is extended or adjusted under 35 U.S.C. 154(b) by 27 days.

(21) Appl. No.: 13/989,068

(22) PCT Filed: Dec. 9, 2011

(86) PCT No.: PCT/IB2011/055581

§ 371 (c)(1),
(2), (4) Date: May 23, 2013

(87) PCT Pub. No.: WO2012/080921

PCT Pub. Date: Jun. 21, 2012

(65) Prior Publication Data

US 2013/0248555 A1 Sep. 26, 2013

Related U.S. Application Data

(60) Provisional application No. 61/422,167, filed on Dec. 12, 2010.

(51) Int. Cl.

| | |
|---|---|
| ***G07F 11/44*** | (2006.01) |
| ***G07F 11/52*** | (2006.01) |
| ***A47G 21/12*** | (2006.01) |
| ***A47G 19/30*** | (2006.01) |
| ***G07F 11/34*** | (2006.01) |

(52) U.S. Cl.

CPC ..... *G07F 11/52* (2013.01); *A47G 21/12* (2013.01); *A47G 21/184* (2013.01); *G07F 11/34* (2013.01); *G07F 11/44* (2013.01)

USPC ..... 221/251; 221/180; 221/209; 221/232; 221/238; 221/177

(58) Field of Classification Search

CPC ..... G07F 11/34; G07F 11/44

USPC ..... 221/177, 178, 179, 180, 188, 189, 195, 221/196, 209, 227, 230, 232, 236, 238, 251, 221/261, 266

See application file for complete search history.

(56) References Cited

U.S. PATENT DOCUMENTS

| | | | | |
|---|---|---|---|---|
| 2,601,118 A * | 6/1952 | Guesmer et al. | ..... | 221/206 |
| 3,519,166 A | 7/1970 | Yingst et al. | | |
| 3,578,207 A * | 5/1971 | Danow | ..... | 221/232 |
| 4,174,787 A | 11/1979 | Merila | | |
| 4,288,004 A | 9/1981 | Goehringer et al. | | |
| 4,299,333 A * | 11/1981 | Welsch | ..... | 221/1 |

FOREIGN PATENT DOCUMENTS

| | | |
|---|---|---|
| WO | 2007056814 | 5/2007 |

* cited by examiner

*Primary Examiner* — Patrick Mackey
(74) *Attorney, Agent, or Firm* — Mark M Friedman

(57) ABSTRACT

An apparatus for dispensing elongated articles such as straws, including: a container for holding the elongated articles; a hopper to receive some of the elongated articles, where the hopper is reversibly movable between a closed state and an open state; and a manipulator for performing a cycle to release a single elongated article by isolating a single article and then moving the hopper from the closed state to the open state, thereby releasing only the single elongated article.

11 Claims, 22 Drawing Sheets

CROSS-SECTION AA'

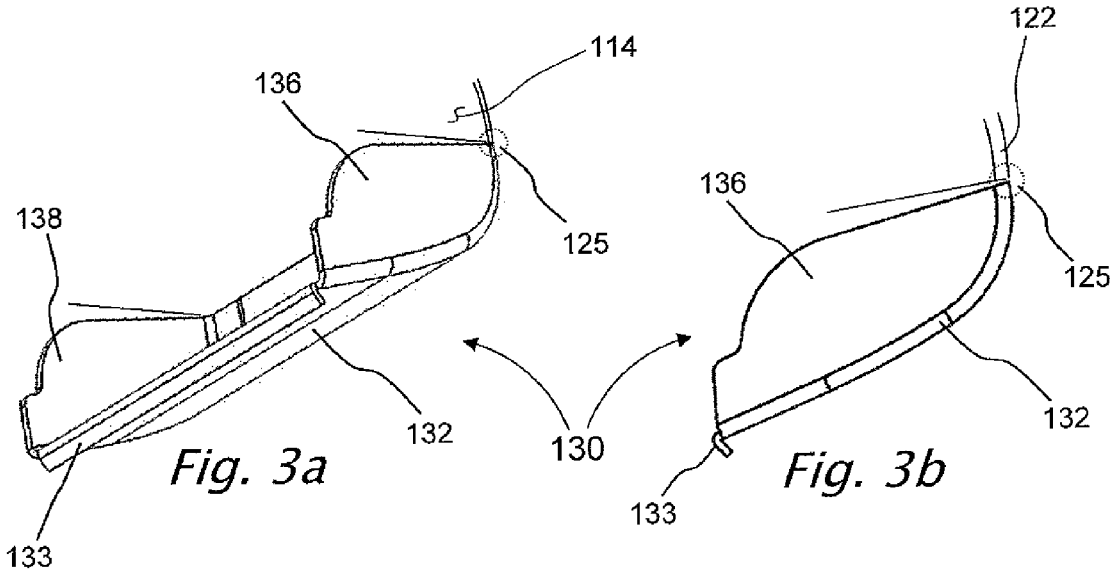
Fig. 3a
Fig. 3b
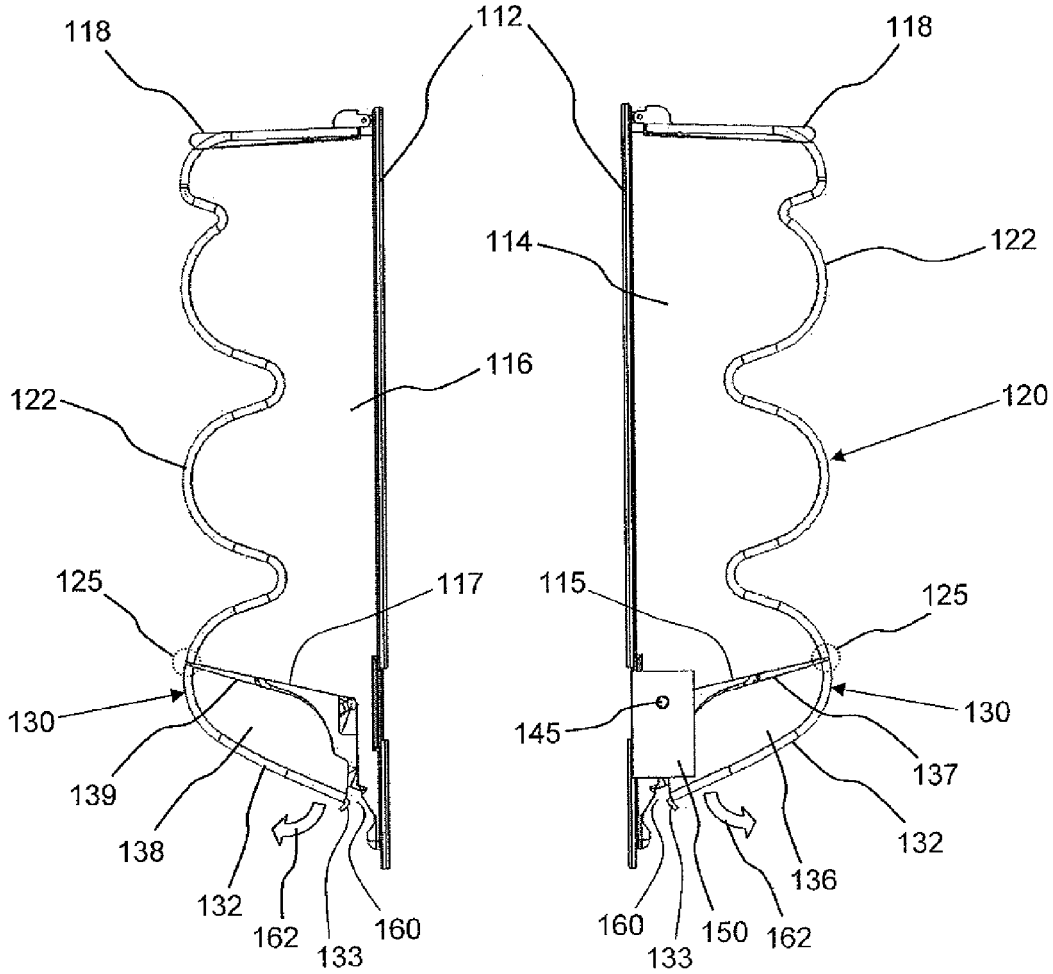
Fig. 4b
Fig. 4a

CROSS-SECTION AA'

CRFOSS-SECTION BB'

DETAILED C

DETAILED D

CRFOSS-SECTION EE'

DETAILED F

APPARATUS FOR DISPENSING ELONGATED ARTICLES

FIELD OF THE INVENTION

The present invention relates to the field of elongated articles dispensing devices. More particularly, the present invention relates to an apparatus for dispensing elongated articles such as pencils, chop sticks, cigarettes and the like, and more specifically, the present invention relates to an automatic sipping straw dispensing apparatus that can be operated independently or as part of a beverage or ice drink vending machine.

BACKGROUND OF THE INVENTION AND PRIOR ART

Sipping straws are commonly used to assist with beverage or ice drink consumption, when drinking from a glass, a cup or containers such as a bottle or a can. Specifically, when the drink is provided by a dispensing machine, many persons prefer to utilize straws for convenience and/or sanitary considerations. As a result, most commercial establishments make straws available to their consumers in order to satisfy their preferences. For example, sipping straws are available through mechanical dispensing devices such that an individual, merely by depressing a lever or turning a knob my effectively dispense a clean sipping straw for their consumption needs. An example of such mechanical dispensing device is provided by Roy William De Visser, in PCT application WO/2007/056814. Another John Merila example of a mechanical dispensing device is provided by Roy William in U.S. Pat. No. 4,174,787.

With regards to automatic dispensing machines, because such machines do not require an attendant be present, and are generally positioned outside or in a confined area, sipping straws are generally not made available. Accordingly, individuals receiving a beverage from an automatic dispenser are generally left to find their own straws.

Generally, most conventional sipping straw dispensing devices are manually actuated bins wherein an individual may pull/push on a lever or turn a knob in order to dispense a straw for their use. A consumer is able to take as many straws as they desire whenever they desire, and generally the bins are located on a counter top or other location such that an employee can ensure that the dispenser is not tampered with or unnecessarily emptied. Unfortunately, however, there is a substantial need in the art for a compact and conveniently useable dispensing assembly which can be implemented with an automatic beverage dispensing machine. Such a device should be able to fit conveniently within existing beverage dispensing machines without taking up substantial space, and be safe and efficient, ensuring that it cannot be un-necessarily emptied.

It is desirable that the device dispenses a single straw at a time and that the straws inside the bin do not clog and/or get stuck.

Attempts have been made in the past to develop automated dispensing machines to dispense sipping straws. U.S. Pat. No. 3,519,166, given to Yingst et al., discloses a sipping straw dispenser to be utilized with a vending machine.

There is a need, and it would be advantageous to have an automatic sipping straw dispensing device which can take up a relatively small space within an automatic dispensing machine, which is not prone to be clogged, and which repeatably dispenses a single straw to the consumer. Furthermore, such a device should be simple and inexpensive, and provide minimal risk of tampering with the straw.

BRIEF SUMMARY OF THE INVENTION

According to the present invention there is provided an apparatus for dispensing elongated articles, including: (a) a container for holding the elongated articles; (b) a hopper operationally coupled to the container to receive at least a portion of the elongated articles, wherein the hopper is reversibly movable between a closed state and an open state; and (c) a manipulator for performing a cycle to release a single one of the elongated articles, the cycle including the steps of: (i) isolating the single article and (ii) moving the hopper from the closed state to the open state, thereby releasing only the single elongated article.

According to further features in preferred embodiments of the invention the container is shaped to retain the elongated articles in a mutually parallel orientation.

According to still further features in the described preferred embodiments the hopper is composed from an elastic material such that the hopper is configured to be bent from the closed state into the open state by an external force exerted by the manipulator, and elastically return to so the closed state when the external force is no longer exerted.

According to still further features the hopper is pivotally coupled to the bottom end of the container and pivotally biased in the closed state by a biasing member.

According to still further features the manipulator is actuated by a crank assembly where the crank assembly is rotatably activated by a motor or manually activated.

According to still further features the apparatus for dispensing the elongated articles is a gravity feed dispensing apparatus.

According to still further features the manipulator is a substantially L-shaped device including: (i) a body portion pivotally attached to the container; and (ii) an isolator, the isolator being substantially perpendicular to the body portion, wherein the isolator is oriented substantially perpendicular to a single layer of the elongated articles, when the elongated articles are at rest in the hopper, so that when actuated, the isolator comes to rest between a first elongated article and a second elongated article, thereby isolating the first elongated article.

According to still further features the apparatus is configured to move the manipulator cyclically through a sequence of states including: (i) an idle state, wherein the manipulator is positioned above a single layer of elongated articles resting on an inner surface of the hopper; (ii) an isolating state, wherein an isolating blade of the manipulator comes to rest on the inner surface of the hopper between a first elongated article and a second elongated article, thereby isolating the first elongated article; and (iii) a dispensing state, wherein the manipulator biases the hopper from the closed state to the open state, whereby a gravity force causes the isolated single elongated article to be dispensed from the apparatus.

According to still further features the cycle to release the single elongated article includes the steps of: (i) actuating the manipulator so as to move the isolator from the idle state to the isolating state; (ii) isolating the single elongated article in the isolating state; and (iii) biasing the hopper from the closed state in a manner sufficient so as to allow the isolated single elongated article to be dispensed from the apparatus; wherein the manipulator returns thereafter to the idle state and the hopper returns to the closed state.

According to another embodiment a vending machine includes the apparatus for dispensing the elongated articles.

According to further features the vending machine is configured to dispense articles selected from the group including: fluid beverages, at least partially frozen fluid beverages, prepackaged meals, closed beverage containers.

According to still further features the vending machine is configured so that a dispensed single elongated article repeatably falls in a substantially similar position each time the article is dispensed.

According to still further features the vending machine is configured so that a dispensed single elongated article repeatably falls into a vessel prior to the vending machine dispensing a pre-selected product into the vessel which now contains an elongated article in a substantially vertical orientation.

BRIEF DESCRIPTION OF THE DRAWINGS

The present invention will become fully understood from the detailed description given herein below and the accompanying drawings, which are given by way of illustration and example only and thus not limitative of the present invention.

FIG. 3*a* is a bottom-front perspective view illustration of a moving and feeding member of the apparatus for dispensing sipping straws shown in FIG. 1.

FIG. 3*b* is a side view illustration of the moving and feeding member of the apparatus for dispensing sipping straws shown in FIG. 1.

FIG. 4*a* is a side view illustration of a first side of the apparatus for dispensing sipping straws shown in FIG. 1.

FIG. 4*b* is a side view illustration of the second side of the apparatus for dispensing sipping straws shown in FIG. 1.

DETAILED DESCRIPTION OF THE INVENTION

A principal intention of the present invention includes providing an automatic dispensing apparatus for dispensing elongated articles and in particular, sipping straw, which apparatus can take up a relatively small space within an automatic dispensing machine, which apparatus is not prone to be clogged, and which apparatus repeatably dispenses a single elongated article to the consumer. Furthermore, the apparatus is simple, inexpensive, and provides minimal risk of tampering with the elongated article. The dispensing apparatus for dispensing elongated articles will now be described, with no limitations, in terms of an apparatus for dispensing sipping straws, but the apparatus of the present invention is not limited to dispensing sipping straws and can be used for dispensing a variety of elongated articles.

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided, so that this disclosure will be thorough and complete, and will fully convey the scope of the invention to those skilled in the art.

Unless otherwise defined, all technical and scientific terms used herein have the same meaning as commonly understood by one of ordinary skill in the art to which this invention belongs. The methods and examples provided herein are illustrative only and not intended to be limiting.

Figure 1:
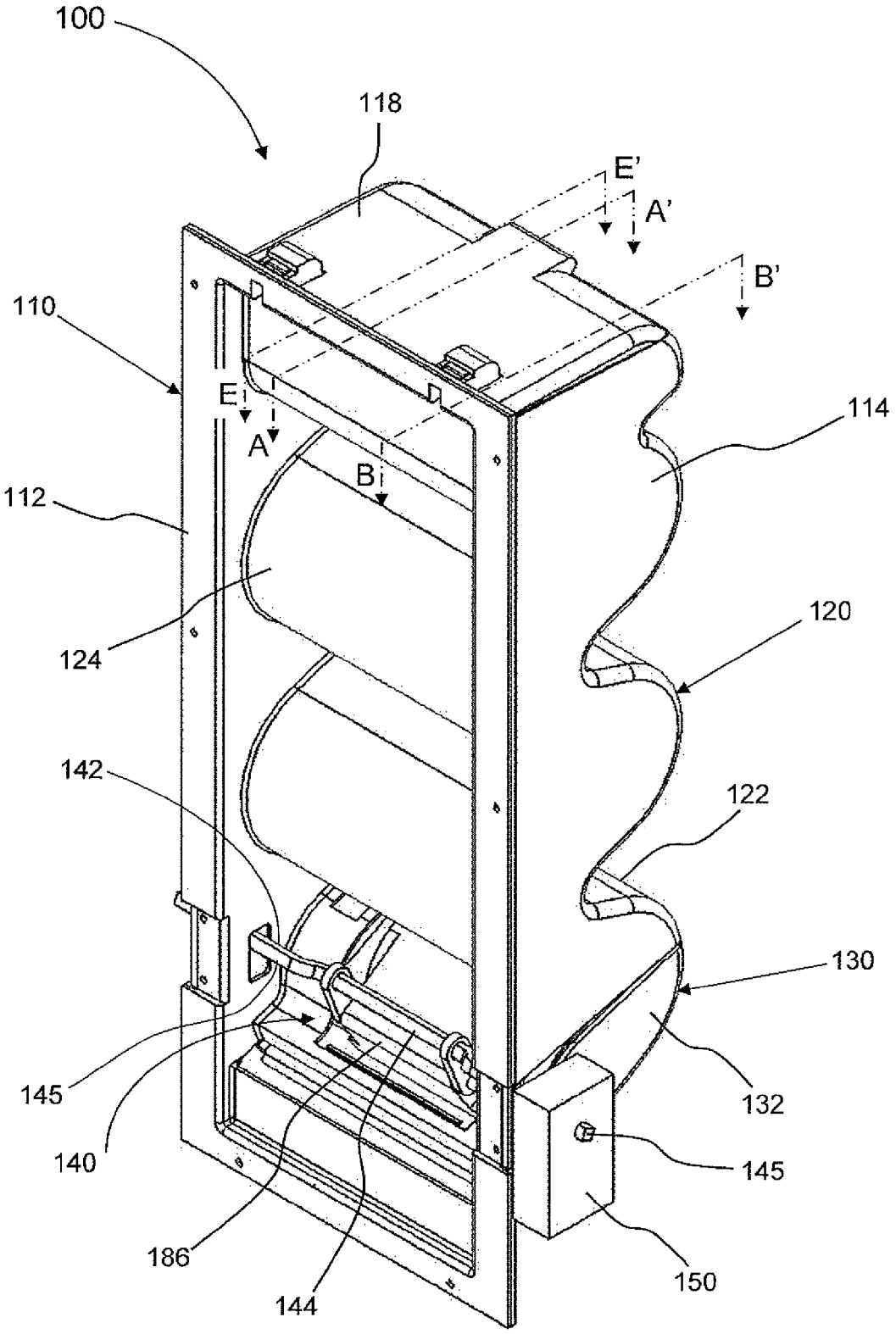
FIG. 1 is a front perspective view illustration of an apparatus for dispensing elongated articles, according to preferred embodiments of the present invention.
Figure 2:
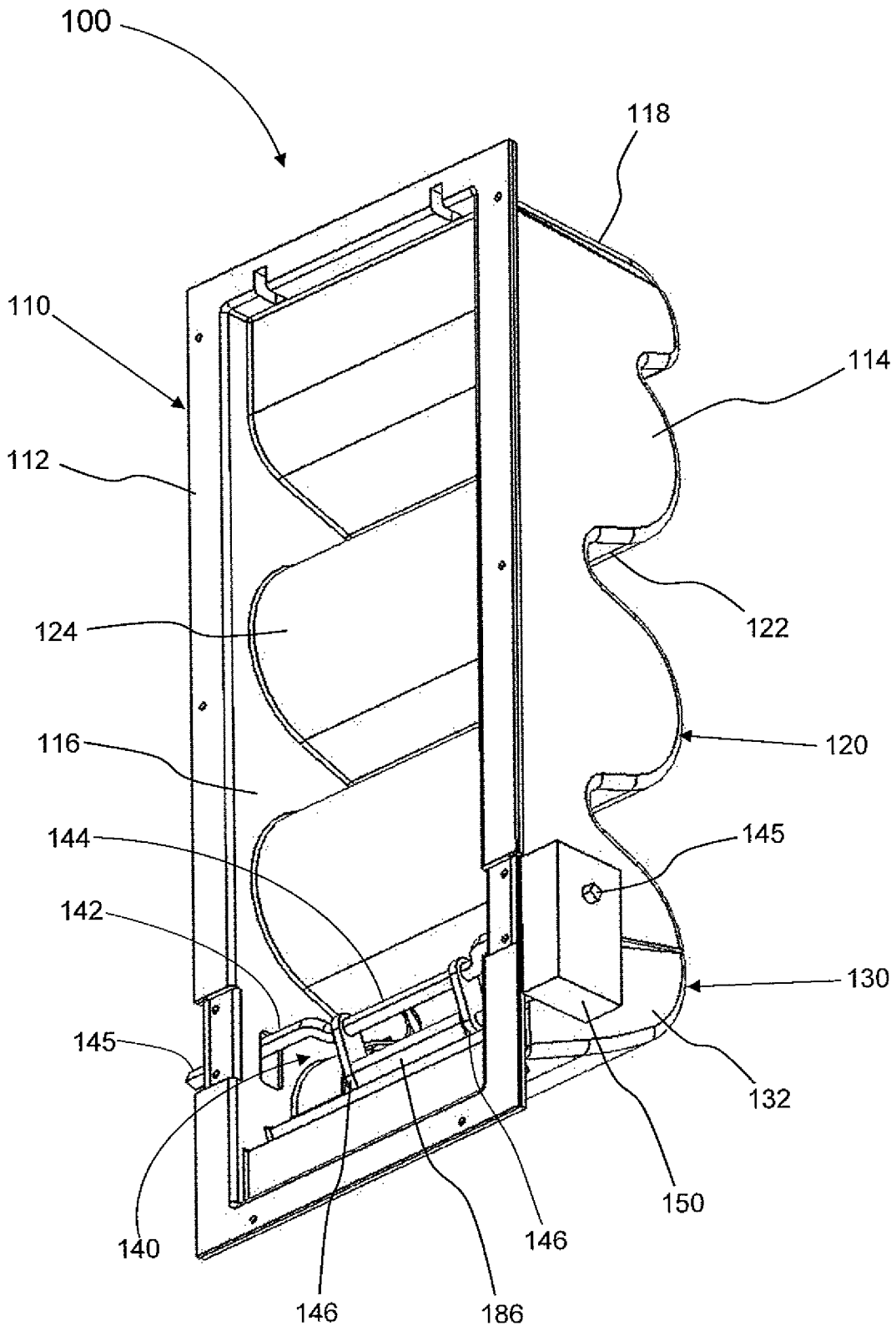
FIG. 2 is a bottom-front perspective view illustration of the apparatus for dispensing sipping straws shown in FIG. 1.

Reference now made to the drawings. FIG. 1 is a front perspective view illustration of an apparatus 100 for dispensing sipping straws, according to preferred embodiments of the present invention. FIG. 2 is a bottom-front perspective view illustration of apparatus 100. Apparatus 100 includes a body 110, a straw container 120, a moving and feeding member/hopper 130, a crank assembly 140 and a motor 150.

Body 110 includes an external interface portion 112 for mounting apparatus 100 onto an inner wall of a drinks dispenser such as a vending machine, or for mounting elsewhere. Straw container 120 is formed by side walls 114 and 116, rear wiggly wall 122 and front wiggly wall 124. On the top end, straw container 120 is preferably enclosed by a lid 118, which lid can be pivotely opened and closed to enable filling up straw container 120 with straws (or other thin and elongated articles such as pencils, chop sticks and the like).

On the bottom end, straw container 120 is enclosed by moving and feeding member/hopper 130. Moving and feeding member 130 is illustrated, by way of example, in FIGS. 3*a* and 3*b*. Moving and feeding member 130 includes a curved wall 132 having a top end that is pivotely attached to the lower end of wall 122. Moving and feeding member 130 further includes a side wall 136 and 138 which walls are preferably flush with side walls 114 and 116 of straw container 120, respectively. It should be noted that walls 136 and 138 are designed such that even when moving and feeding member 130 is in the lowermost position, straws cannot drop out of straw container 120, sideways.

Preferably, with no limitation, rear wiggly wall 122 and front wiggly wall 124 have a wave like form to keep the straws inside straw container 120 substantially (operatively) horizontal and thereby prevent clogging of the straws inside straw container 120. The wave form prevents straws being dropped through lid 118, to be vertically oriented or otherwise diagonally oriented, and forces the dropped elongated articles, such as sipping straws, to obtain a generally horizontal orientation.

Reference is also made to FIG. 4*a*, which is a side view illustration of a first side of apparatus 100 and to FIG. 4*b*, which is a side view illustration of the second side of the apparatus 100. In FIGS. 4*a* and 4*b*, moving and feeding member 130 is shown partially open, wherein the top end 139 of side wall 138 is not adjacent to lower end 117 of side wall 116 of body 110, and the top end 137 of side wall 136 is not adjacent to lower end 115 of side wall 114 of body 110. The motion of moving and feeding member 130 in direction 162 forms an opening 160, which opening facilitates the dropping of a straw for inside straw container 120.

Figure 5:
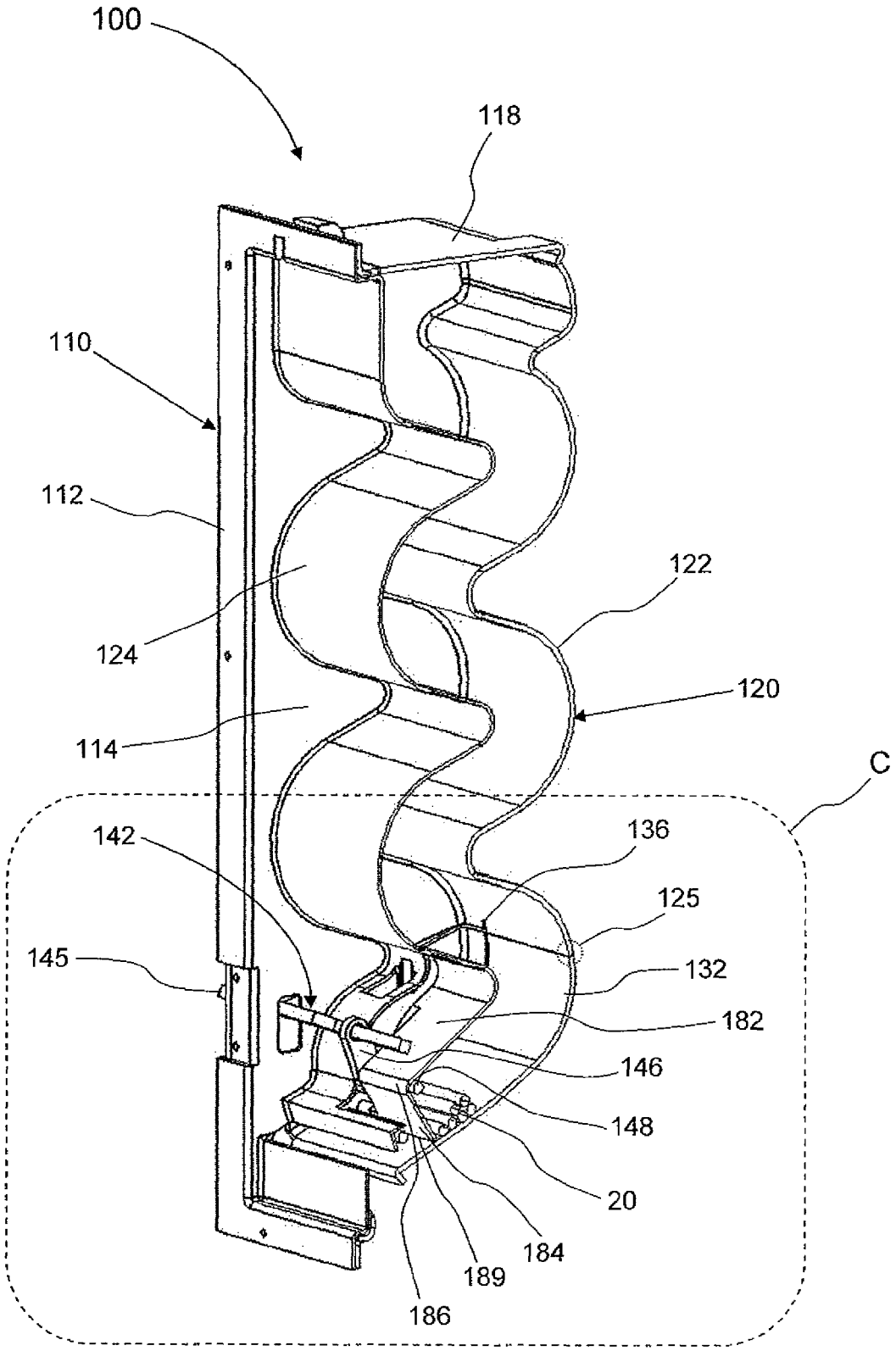
FIG. 5 illustrates a perspective, cross-section AA' view of the apparatus for dispensing sipping straws shown in FIG. 1.
Figure 6:
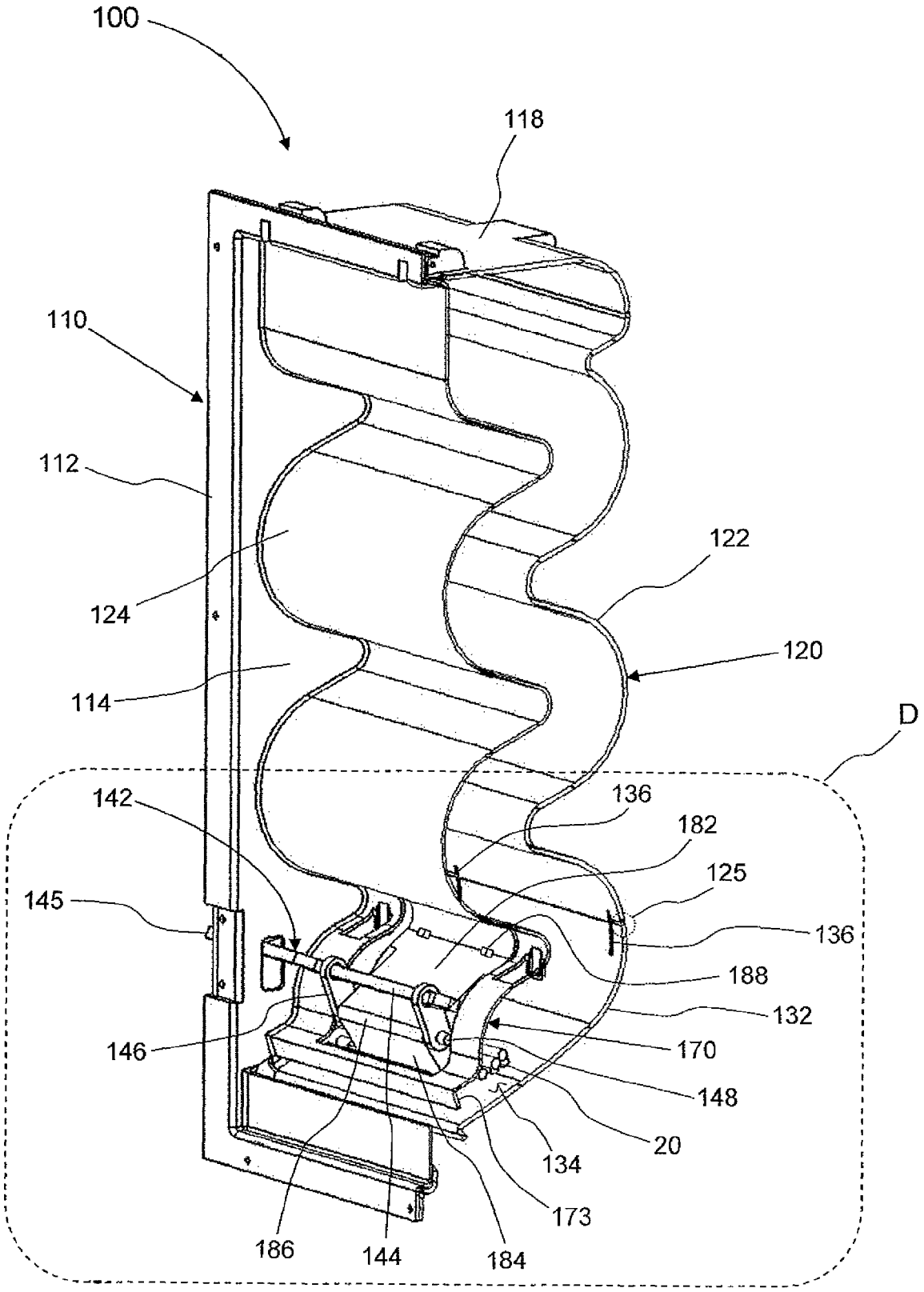
FIG. 6 illustrates a perspective, cross-section BB' view of the apparatus for dispensing sipping straws shown in FIG. 1.
Figure 7:
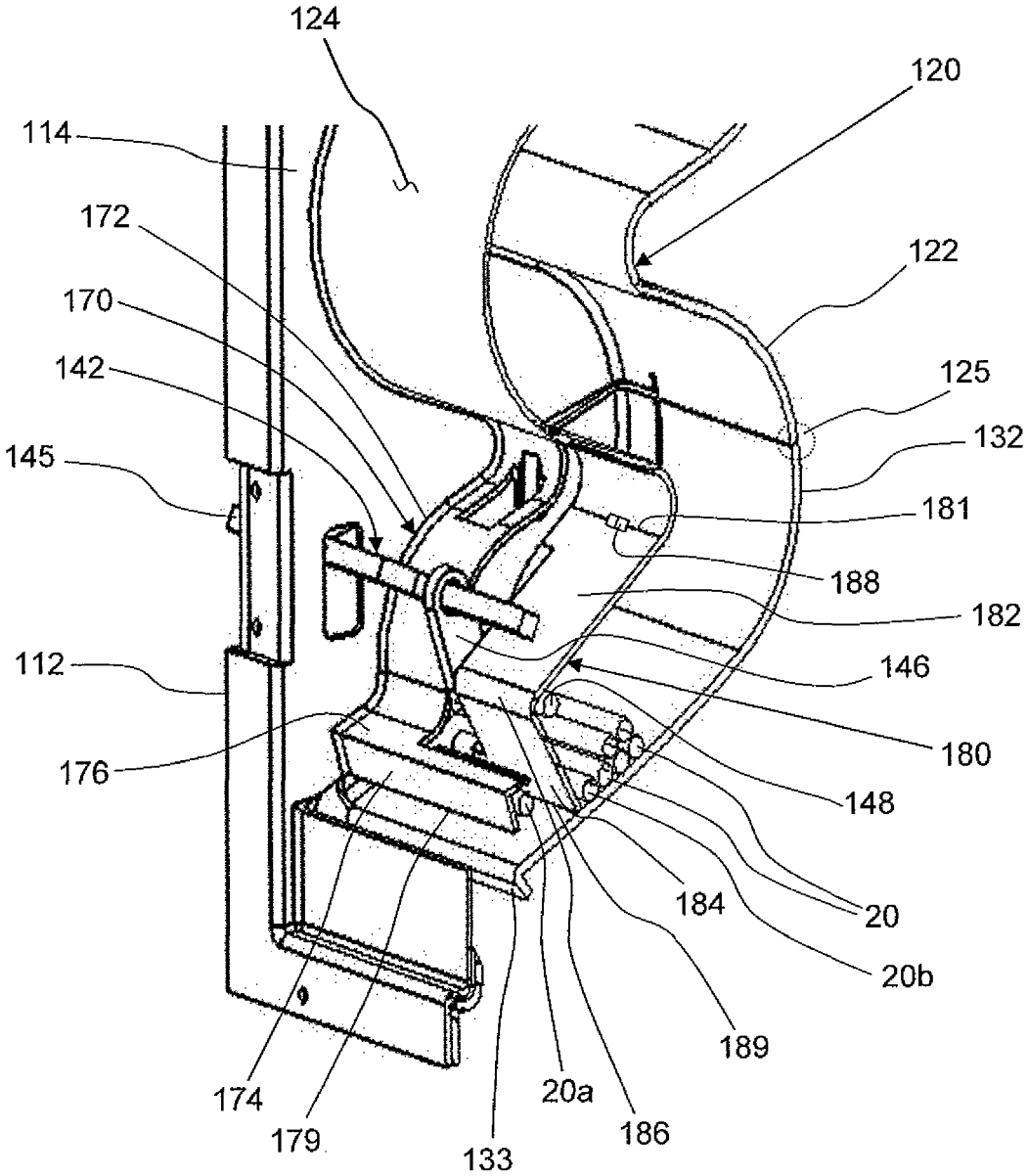
FIG. 7 is a magnified view of window "C" shown in FIG. 5.
Figure 8:
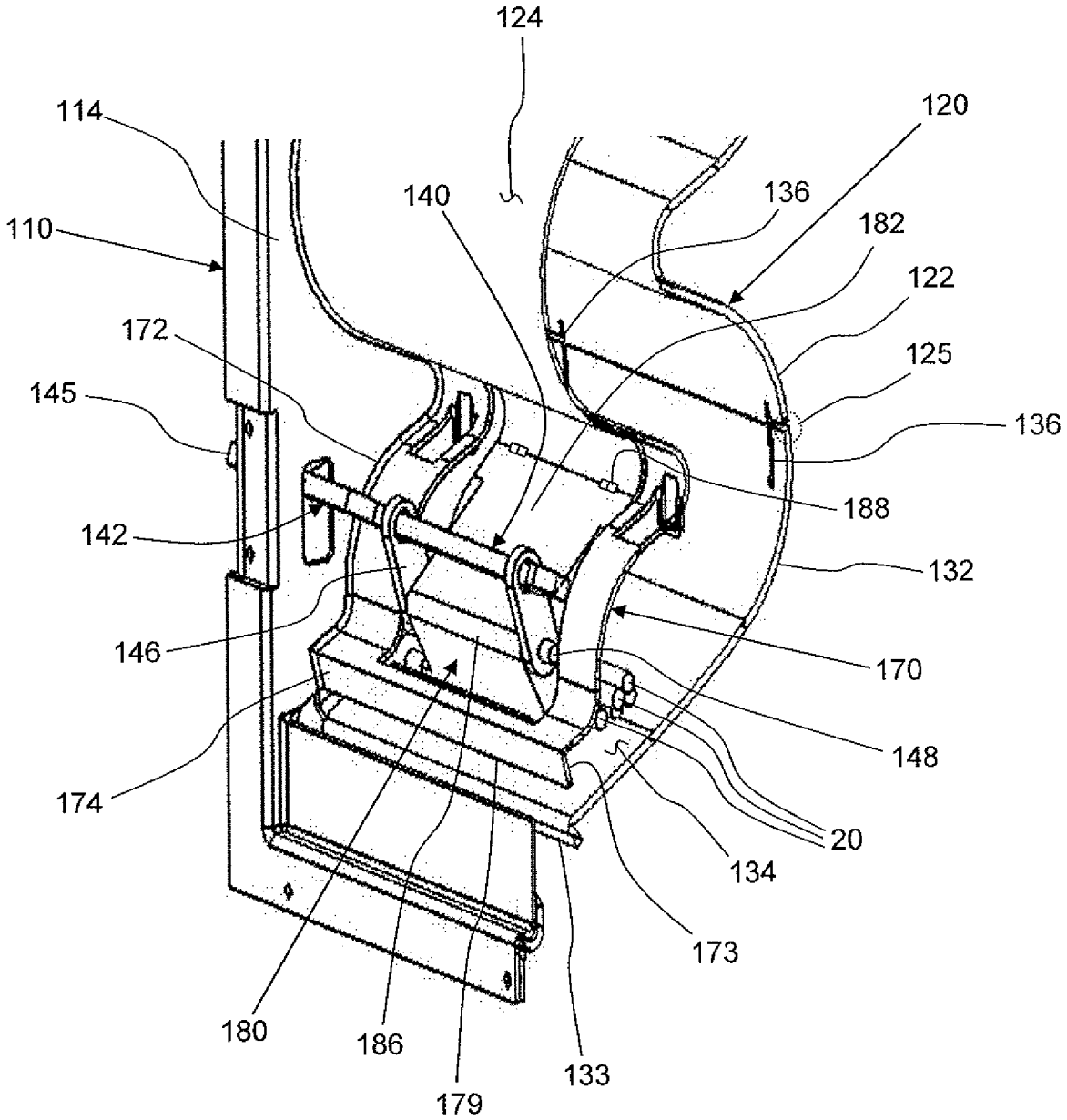
FIG. 8 is a magnified view of window "D" shown in FIG. 6.

Reference is also made to FIG. 5, which illustrates a perspective, cross-section AA' view of apparatus 100 for dispensing sipping straws, and to FIG. 6, which illustrates a perspective, cross-section BB' view of apparatus 100. FIG. 7 is a magnified view of window "C" shown in FIG. 5 and FIG. 8 is a magnified view of window "D" shown in FIG. 6.

Figure 9A:
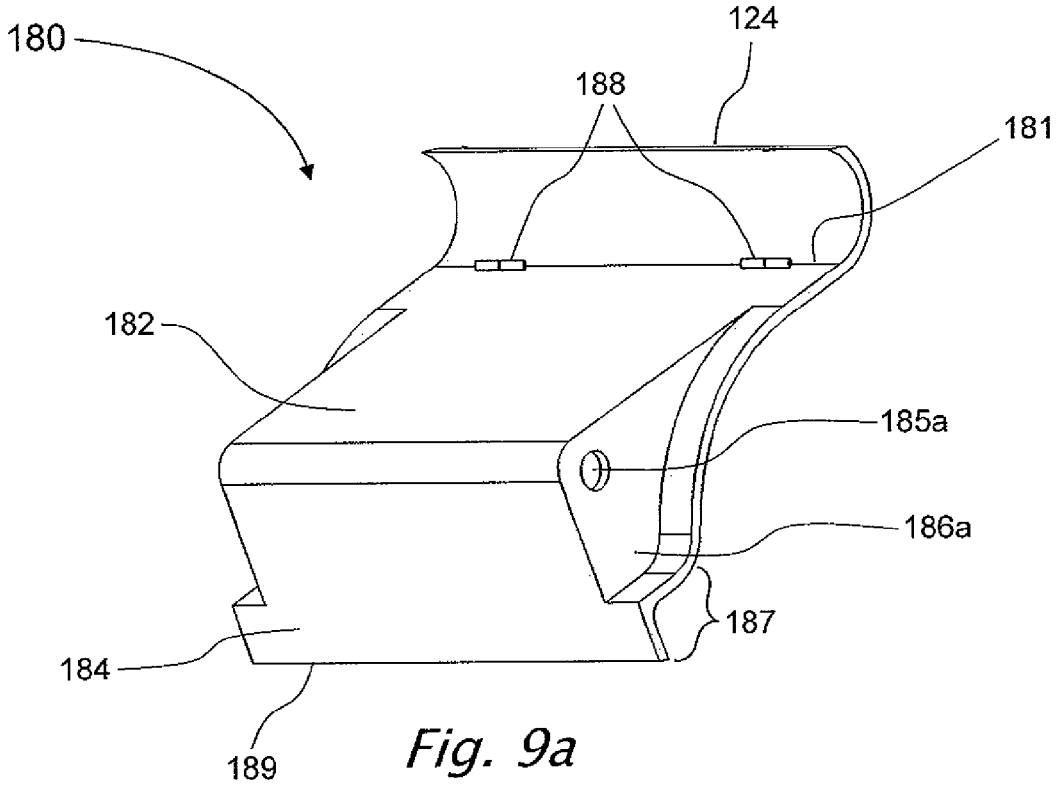
FIG. 9*a* is a front perspective view illustration of a straw manipulator of the front wiggly wall of the straw container.
Figure 9B:
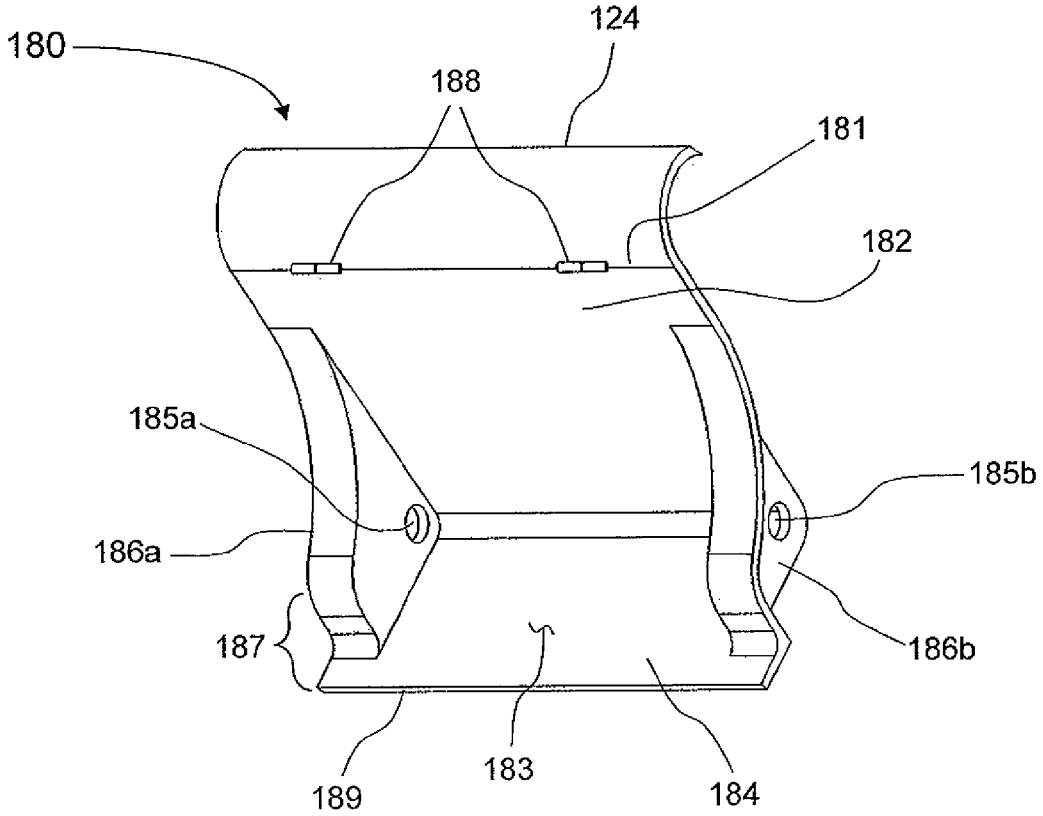
FIG. 9*b* is a bottom-rear perspective view illustration of a straw manipulator of the front wiggly wall of the straw container.

Straw container 120 is typically made of substantially rigid materials such as metal or plastic or other polymers or other materials. Reference is also made to FIG. 9*a*, which is a front perspective view illustration of a straw manipulator 180 of front wiggly wall 124 of the straw container 120 and FIG. 9*b* is a bottom-rear perspective view illustration of straw manipulator 180 of front wiggly wall 124 the straw container 120. On both sides of straw manipulator 180, the front wiggly wall 124 of the straw container 120 extends in two strips 172 further beyond straw manipulator 180 and encloses by an end panel 174, having a flat edge 179, on which edge 179, inner surface 134 of moving and feeding member 130 rests, when apparatus 100 is in idle state. The portion of rigid front wiggly wall 124, containing strips 172, and up to and including end panel 174, is referred to as straw leading member 170. For the sake of clarity, front wiggly wall 124 of the straw container 120 extends in two strips 172 further beyond straw manipulator 180 and encloses by an end panel 174, having a flat edge 179, on which edge 179, inner surface 134 of moving and feeding member 130 rests, when apparatus 100 is in idle state. The portion of rigid front wiggly wall 124, including straw leading member 170 are rigid, non-moving part.

Straw manipulator 180 forms an L-shaped device, having a body portion 182 that generally follows the local shape of front wiggly wall 124 and is pivotely attached to front wiggly wall 124, and an isolator 184 that is generally perpendicular to body section 182, and wherein the upper end 181 of body section 182 of straw manipulator 180 is pivotely attached to a lower portion of front wiggly wall 124 and the other three side edges of straw manipulator 180 remain unattached. When actuated, the L-shaped straw manipulator 180 is bent towards moving and feeding member 130, wherein a blade 189 at the open end of isolator 184 of straw manipulator 180 is operatively coupled with inner surface 134 of moving and feeding member 130. Two respective side walls 186 interconnect and re-enforce the body section 182 and isolator 184. At the section 187 proximal to blade 189 of isolator 184 each side wall 186 has a predesigned form to facilitate a space that can accommodate just straw height between the wall section that is generally parallel to surface 134 of moving and feeding member 130, and surface 134 of moving and feeding member 130.

Optionally, the L-shaped straw manipulator 180 is made from elastic material such that straw manipulator 180 is able to return to its original shape after being bent.

Optionally, the L-shaped straw manipulator 180 is made from rigid material such that straw manipulator 180 is able to pivot on a hinge, for example, and return to its initial closed position by a biasing force such as a spring.

Optionally, moving and feeding member 130 is made from elastic material such that moving and feeding member 130 is able to return to its original shape after being bent by said L-shaped straw manipulator 180.

Optionally, moving and feeding member 130 is made from rigid material such that moving and feeding member 130 is able to pivot on a hinge, for example, and return to its initial closed position by a biasing force such as a spring.

Figure 10:
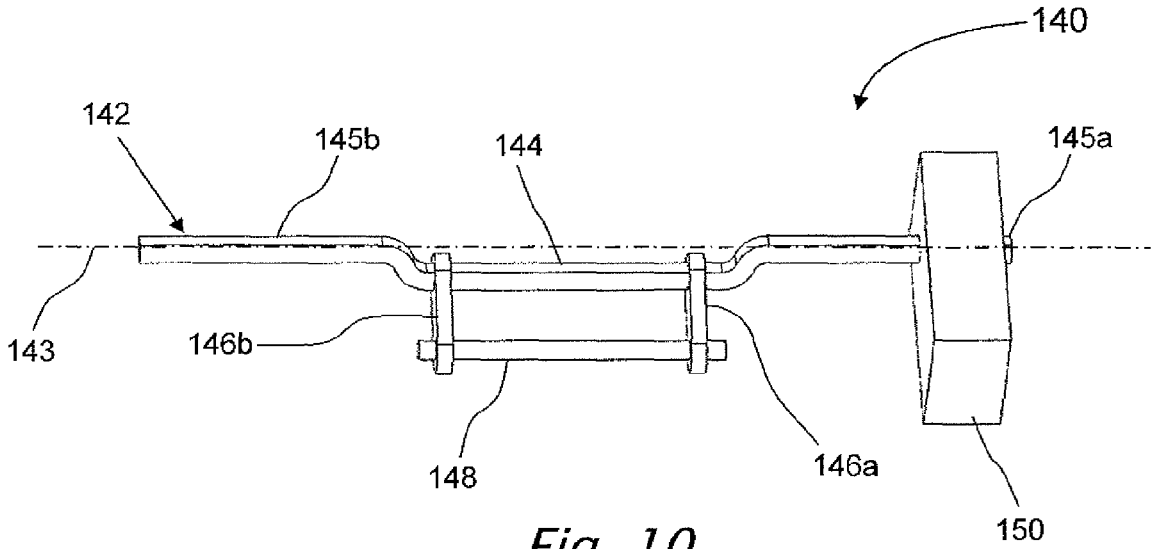
FIG. 10 is a perspective view illustration of a crank of the apparatus for dispensing sipping straws shown in FIG. 1.

Crank assembly 140 is rotatably activated by motor 150 to perform a cycle for releasing a single sipping straw, upon request. Reference is also made to FIG. 10, which is a perspective view illustration of a crank assembly 140 of apparatus 100 for dispensing sipping straws. Crank assembly 140 includes crank 142 having rotating shafts 145 that operatively rotates about axis 143 and eccentric portion 144, one or preferably a pair of connecting bars 146, and a moving axis 148. Motor 150 is operatively connected to a first shaft 145*a* and thereby, when activated, rotates crank 142 about shafts 145. Eccentric portion 144 is rotatably connecting to a first end of bars 146, and moving axis 148 is rotatably connecting to the second end of bars 146.

Figure 11:
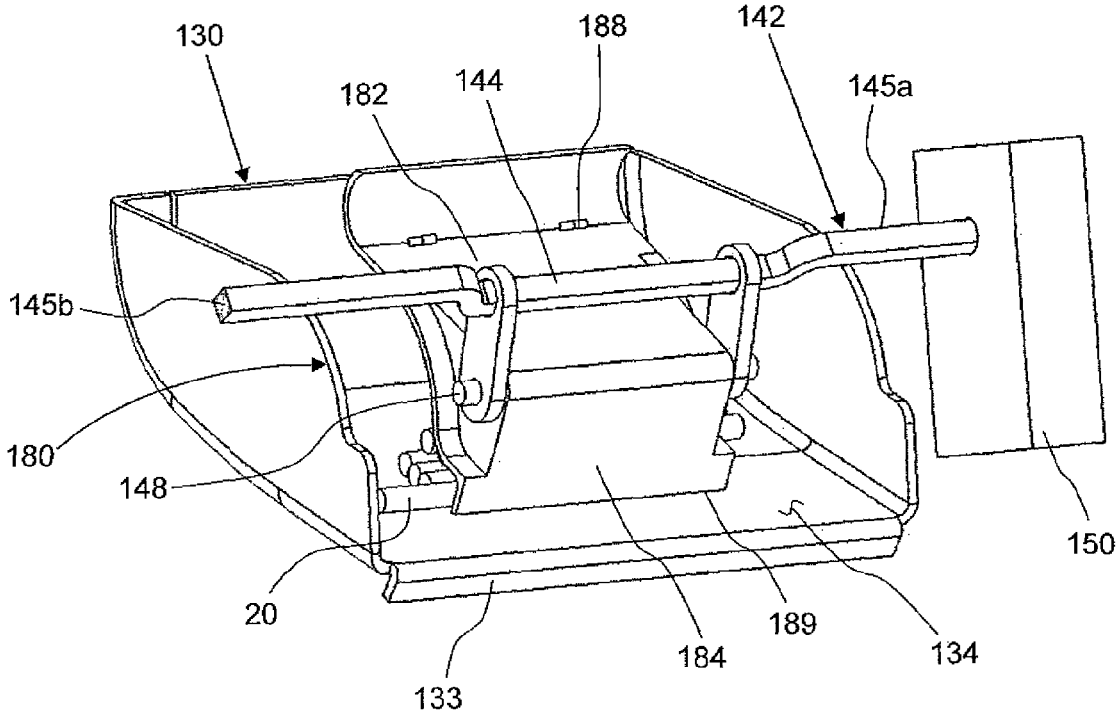
FIG. 11 is a perspective view illustration of a portion of the apparatus for dispensing sipping straws shown in FIG. 1, which portion includes the moving parts of the apparatus.

Reference is also made to FIG. 11, which is a perspective view illustration of a portion of apparatus 100 for dispensing sipping straws, which portion includes the moving parts of the apparatus 100. Moving axis 148 is mounted, readily pivotable, into fitted openings 185 (see FIGS. 9*a* and 9*b*) formed in a predesigned location in re-enforcing side walls 186. Hence, when crank 142 rotates about shafts 145, connecting bars 146, pivotely mounted at a first end onto crank 142 and thereby, each respective first end of connecting bars 146 moves in a circle about the rotational axis of shafts 145. The second end of each connecting bar 146 follows the motion of the respective first end, constrained by the fact that each respective second end of connecting bars 146 is pivotely mounted onto a respective end of moving axis 148. Thereby, straw manipulator 180 is pushed and pulled back both inwardly and outwardly with respect to the inner space of straw container 120, as well as remittently pushing along inner surface 134 of moving and feeding member 130. The remittent pushing of inner surface 134 causes the back and forth motion of moving and feeding member 130, in direction 162.

Figure 12:
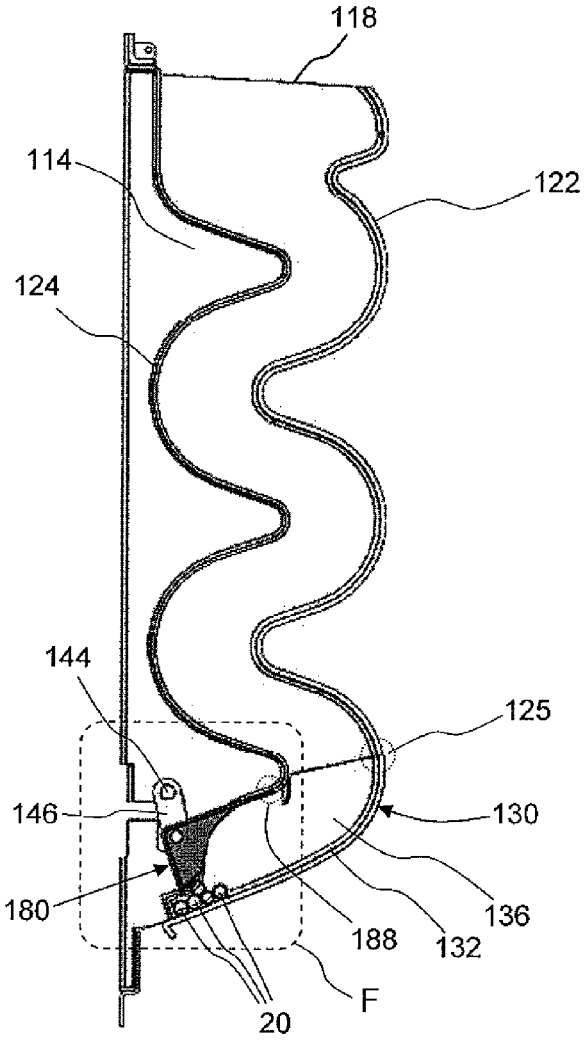
FIG. 12 illustrates a side, cross-section EE' view of the apparatus for dispensing sipping straws shown in FIG. 1.
Figure 13:
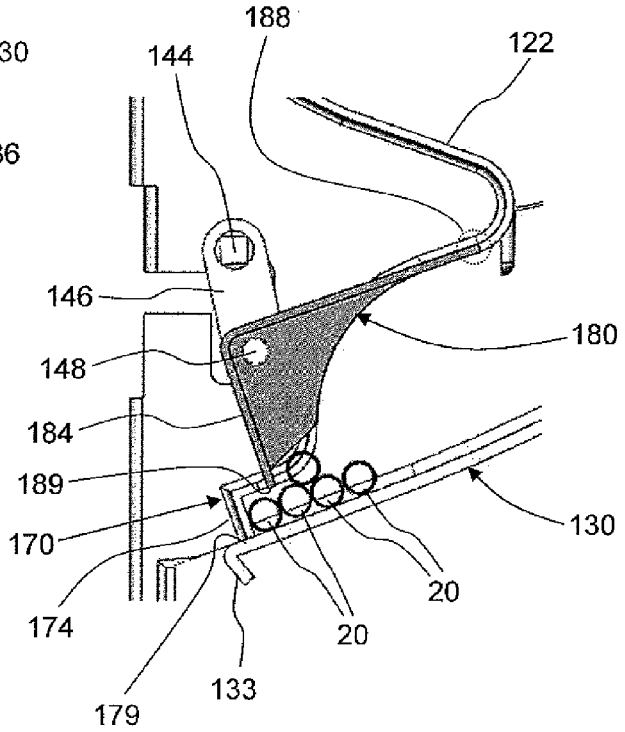
FIG. 13 is a magnified view of window "F" shown in FIG. 12.

Reference is also now made to FIG. 12, which illustrates a side, cross-section EE' view of the apparatus for dispensing sipping straws 100, and to FIG. 13, which is a magnified view of window F, as shown in FIG. 12. The dispensing of a single straw 20, upon each such request, is facilitated by a predesigned geometry on synchronous motion of straw manipulator 180 and feeding member 130, wherein straw manipulator 180 is configured to operatively pivot about axis 188 and feeding member 130 is configured to operatively pivot about axis 125.

Figure 15A:
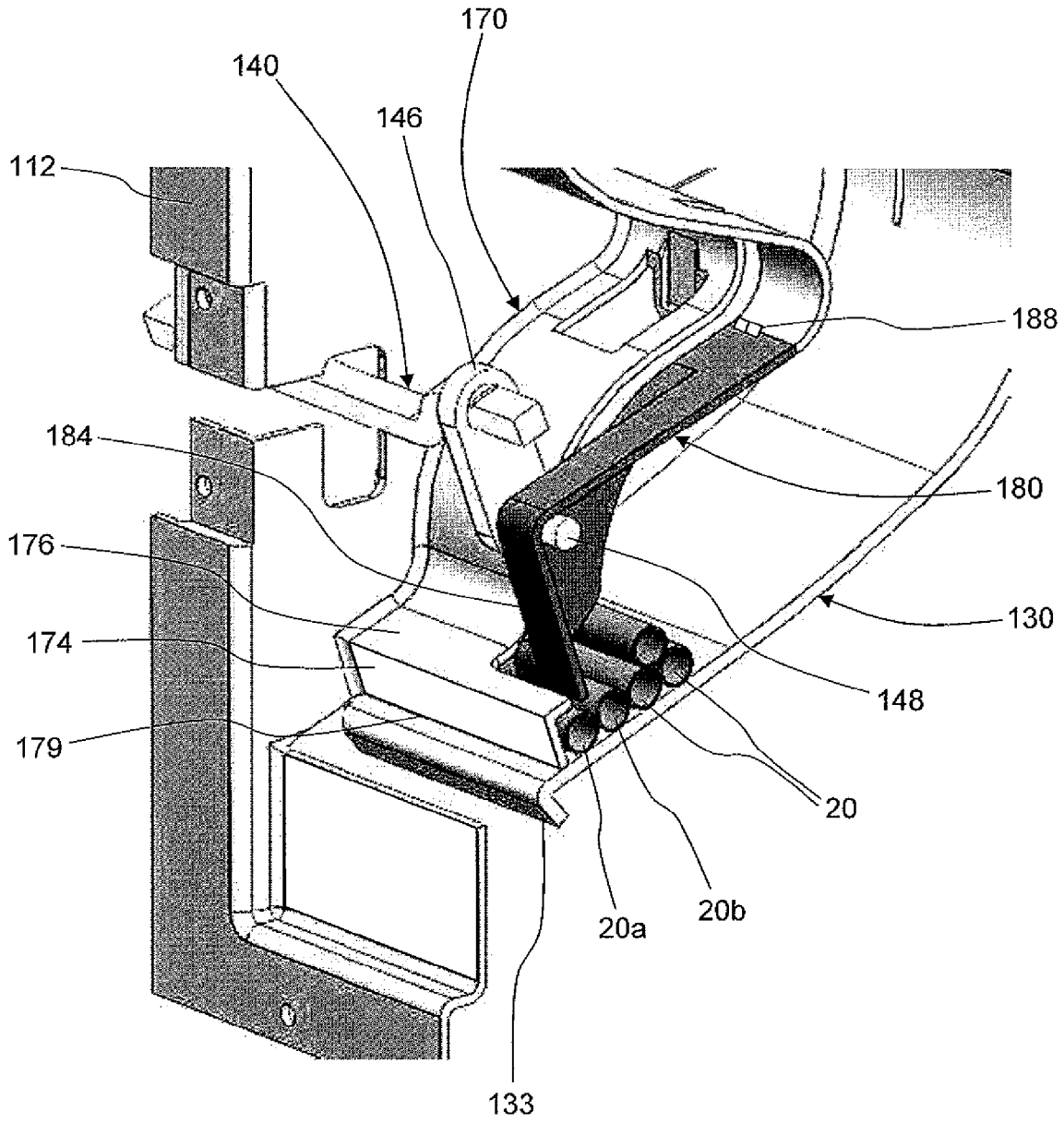
FIG. 15*a* is a magnified perspective view of the straw releasing mechanism, generally delimited by window "F" shown in FIG. 12, wherein the apparatus for dispensing sipping straws is in idle state.
Figure 15B:
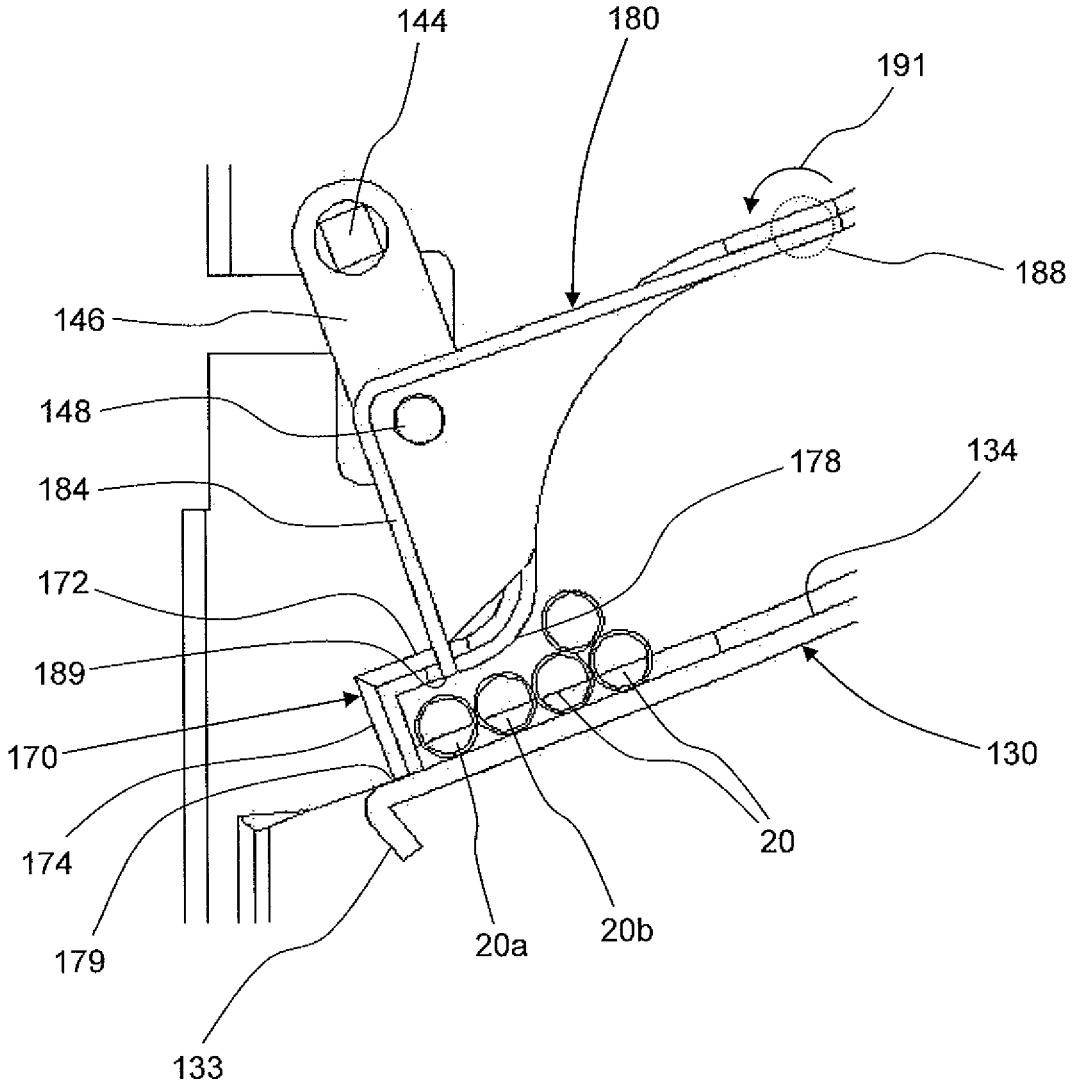
FIG. 15*b* is a side view of the straw releasing mechanism, in the state as generally shown in FIG. 15*a*.

Reference is also now made to FIG. 15*a*, which is a magnified perspective view of the straw releasing mechanism of the apparatus for dispensing sipping straws 100, generally delimited by window "F" shown in FIG. 12, wherein the straw releasing mechanism of apparatus for dispensing sipping straws 100 is in idle state; and to FIG. 15*b*, which is a side view of the straw releasing mechanism, in the state as generally shown in FIG. 15*a*. All moving parts are in idle state, being kept there by a biasing force (not shown), such as the elasticity of the materials from which the parts are made, a spring or any other conventional biasing force.

In an idle state, straw manipulator 180 is situated above the first layer of straws (including 20*a* and 20*b*), which layer is disposed on inner surface 134 of moving and feeding member 130. Inner surface 134 of moving and feeding member 130 is kept, by the mentioned above biasing force, adjacent to flat edge 179 of end panel 174 of straw leading member 170. Thereby, the first layer of straws is leaning against the inner surface 173 (see FIG. 6) of end panel 174, which panel 174 prevents from the straws from rolling out of straw container 120.

Figure 14:
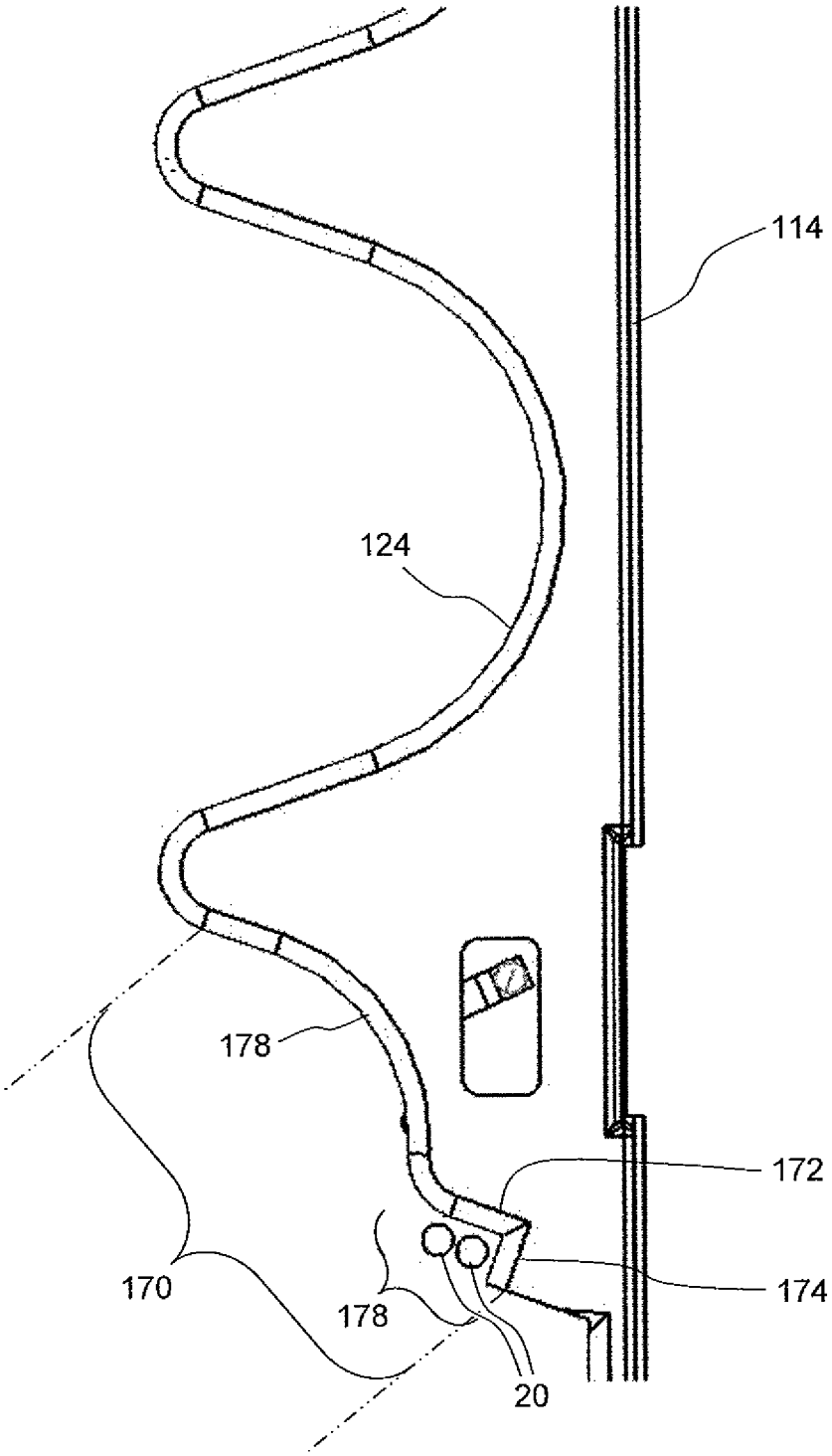
FIG. 14 illustrates the front wiggly wall of the straw container of the apparatus for dispensing sipping straws shown in FIG. 1, including a straw leading member.

Reference is also now made to FIG. 14, which illustrates front wiggly wall 124 of straw container 120, including straw leading member 170. The predesigned profile of straw hub 178 that forms a space between surface 134 and the inner surface wall 172, that is generally parallel to surface 134 of moving and feeding member 130, which space has a height that can accommodate a layer of straws including at least two straws that are disposed on surface 134, having no other straws on top of them, and which first straw leans against inner surface 173 (see FIG. 6) of end panel 174.

Reference is made back to FIGS. 15*a* and 15*b*, showing dispensing sipping straws 100 in idle state. A layer of straws including straws 20*a* and 20*b* are disposed on surface 134, having no other straws on top of them, and which first straw 20*a* leans against inner surface 173 (see FIG. 6) of end panel 174. Straw manipulator 180 is facilitated to pivot in direction 191, when motor 150 is activated to move eccentric portion 144 of crank 142. It should be noted that blade 189 of isolator 184 is situated above first straw 20*a* and second straw 20*b*, and hence, when motor 150 is activated, blade 189 will move down between first straw 20*a* and second straw 20*b*.

Figure 16A:
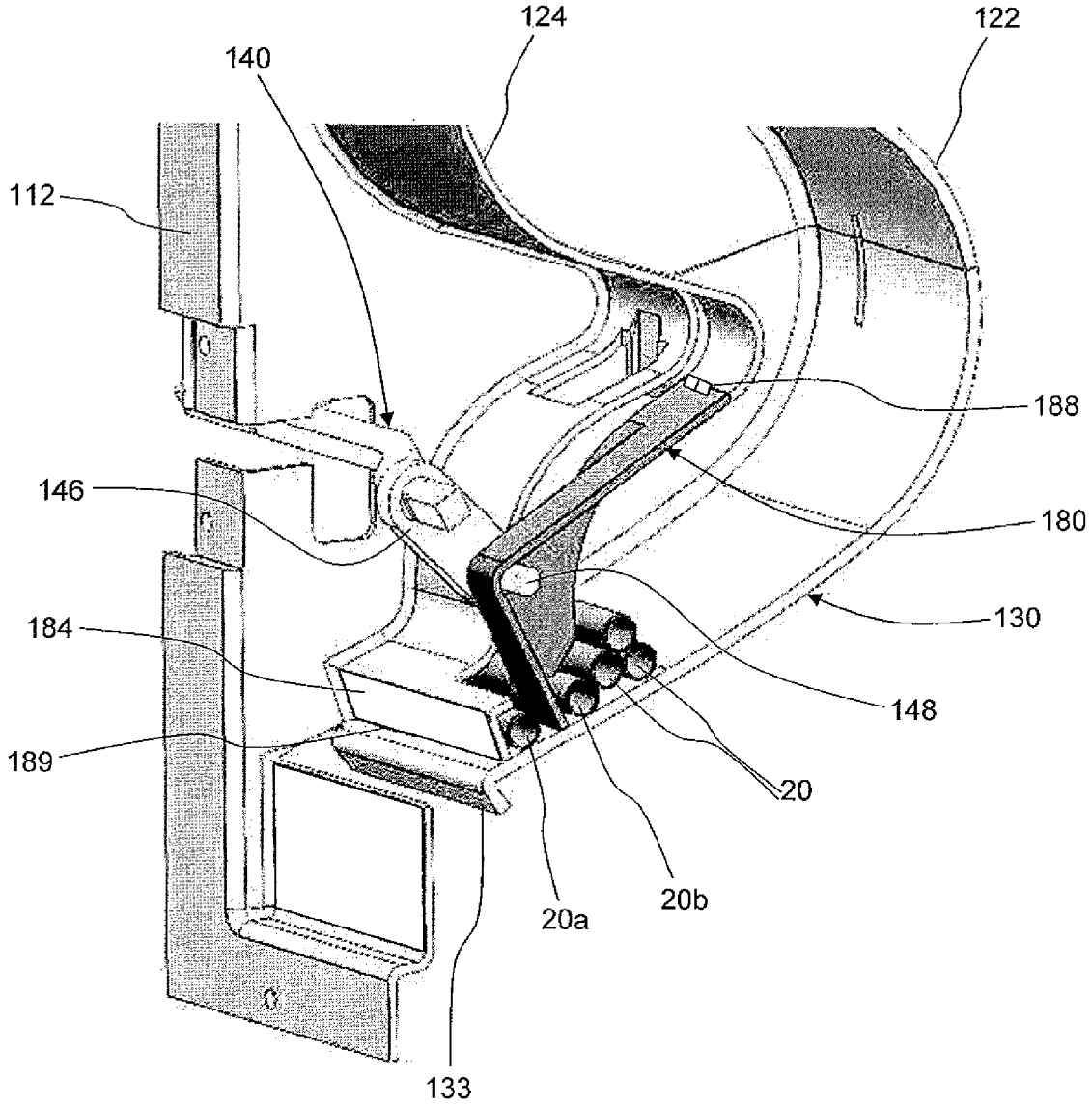
FIG. 16*a* is a magnified perspective view of the straw releasing mechanism, generally delimited by window "F" shown in FIG. 12, wherein the next single straw to be released is isolated.
Figure 16B:
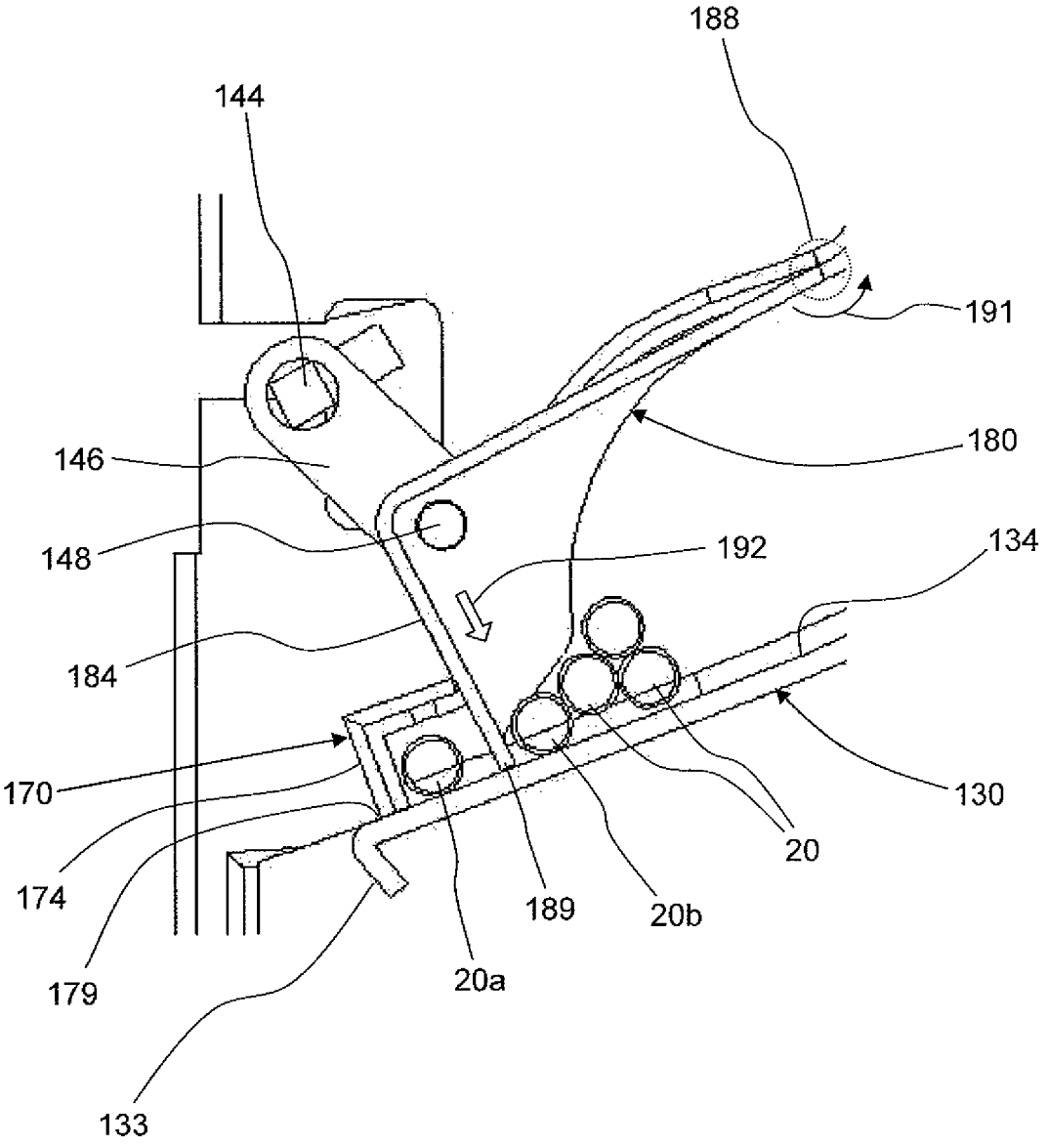
FIG. 16*b* is a side view of the straw releasing mechanism, in the state as generally shown in FIG. 16*a*.

Reference is now made to FIG. 16*a*, which is a magnified perspective view of the straw releasing mechanism of dispensing sipping straws 100, generally delimited by window "F" shown in FIG. 12, wherein the next single straw (20*a*) to be released is isolated; and to FIG. 16*b*, which is a side view of the straw releasing mechanism, in the state as generally shown in FIG. 16*a*. As shaft 145 rotates, eccentric portion 144 moves in direction having a downward vector, pushing connecting bars 146 and thereby moving axis 148 in a general downwardly direction 192. Moving axis 148 then pushes isolator 184 of straw manipulator 180 in direction 192, as straw manipulator 180 pivots about axis 188, in direction 191. As isolator 184 moves forcefully in direction 192, blade 189 moves in between first straw 20*a* and second straw 20*b* to thereby isolate first straw 20*a* from the rest of the straws 20, disposed inside straw container 120. In FIGS. 16*a* and 16*b*, blade 189 is seen adjacent to inner surface 134 of moving and feeding member 130, after isolating first straw 20*a* from the rest of the straws 20. Isolated first straw 20*a* is now in position to be solely dispensed from apparatus for dispensing sipping straws 100.

Figure 17A:
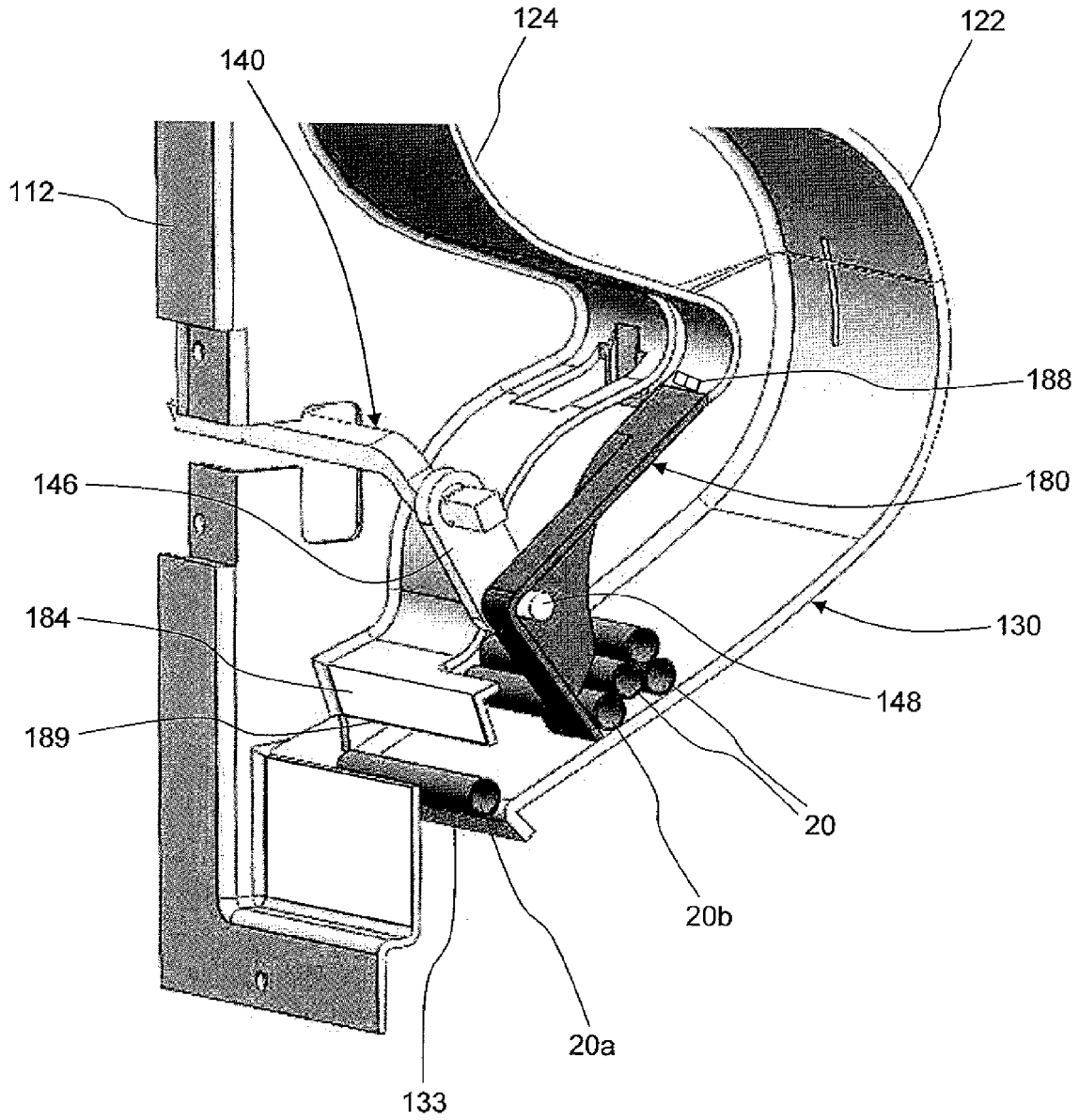
FIG. 17*a* is a magnified perspective view of the straw releasing mechanism, generally delimited by window "F" shown in FIG. 12, wherein the isolated straw has just been released.
Figure 17B:
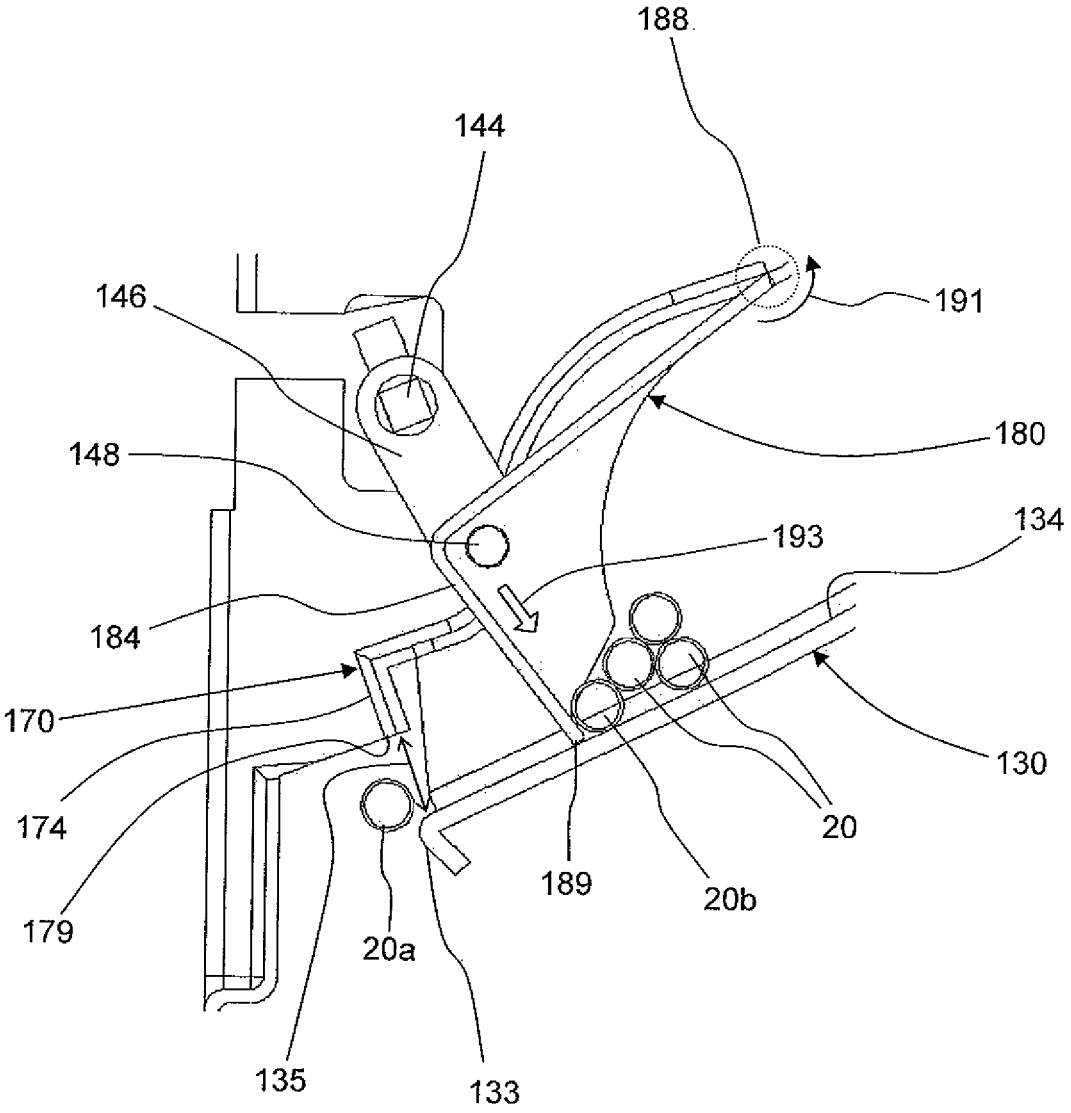
FIG. 17*b* is a side view of the straw releasing mechanism, in the state as generally shown in FIG. 17*a*.

Reference is now made to FIG. 17*a*, which is a magnified perspective view of the straw releasing mechanism of dispensing sipping straws 100, generally delimited by window "F" shown in FIG. 12, wherein isolated straw 20*a* has just been released; and to FIG. 17*b*, which is a side view of the straw releasing mechanism, in the state as generally shown in FIG. 17*a*. As shaft 145 rotates further, eccentric portion 144 continues to moves in direction having a downwardly vector as well as a vector towards the inside of straw container 120, pushing connecting bars 146 and thereby moving axis 148 in a general downwardly direction 193. Moving axis 148 then pushes isolator 184 in direction 193, as straw manipulator 180 pivots about axis 188, in direction 191. As isolator 184 moves forcefully in direction 193, blade 189 forcefully pushes inner surface 134 of moving and feeding member 130 in direction 193, thereby forming a gap 135 between flat edge 179 of end panel 174 of straw leading member 170 and inner surface 134. When gap 135 is larger than the diameter of first straw 20*a*, isolated straw 20*a* drops out of the straw releasing mechanism of the apparatus for dispensing sipping straws 100, using gravity force. As isolator 184 moves also in the direction of the pushing vector directed towards the inside of straw container 120, isolator 184 slides over inner surface 134 and shovels the rest of straws 20 towards the inside of straw container 120.

Figure 18A:
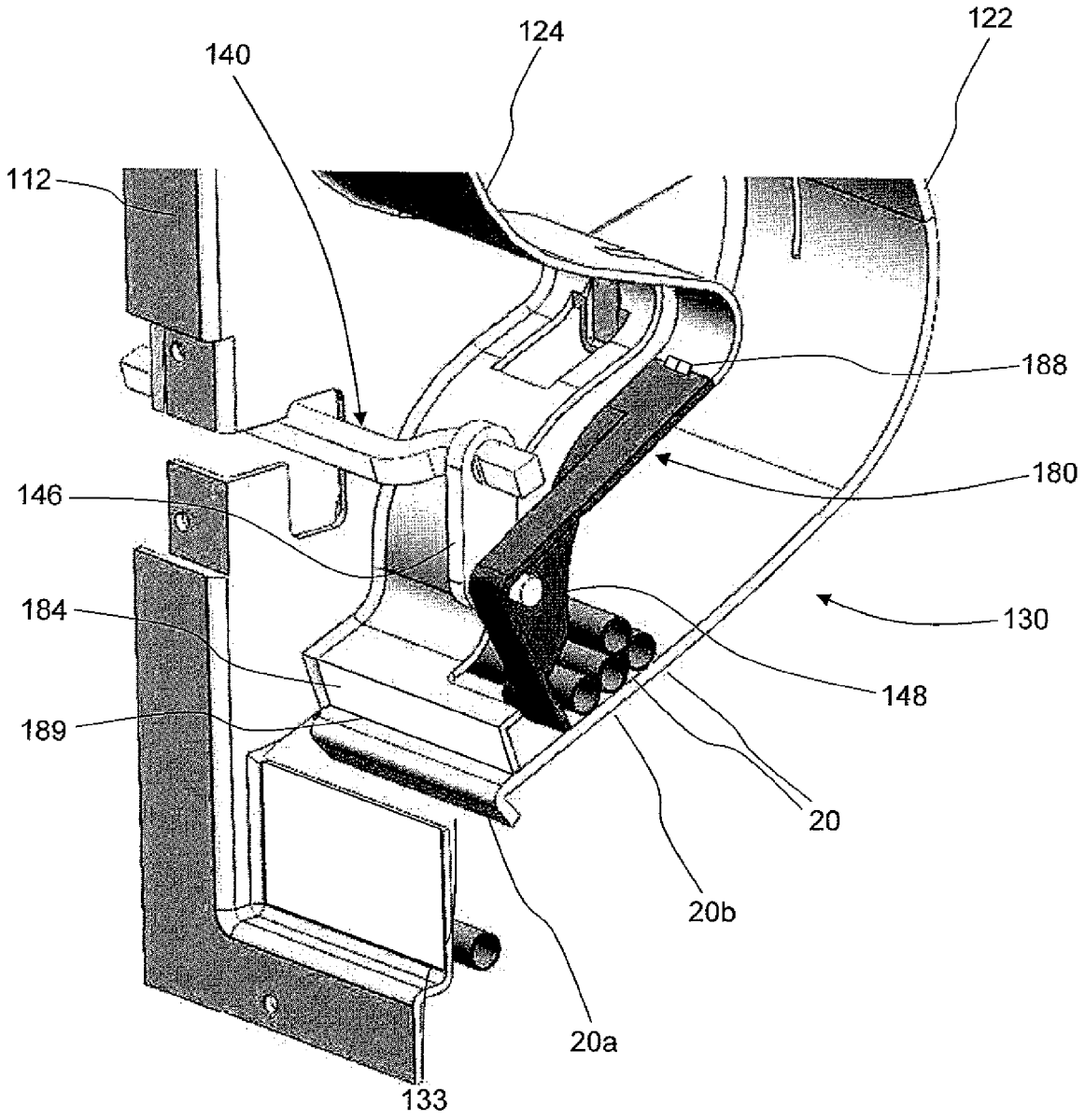
FIG. 18*a* is a magnified perspective view of the straw releasing mechanism, generally delimited by window "F" shown in FIG. 12, wherein the isolated straw is still dropping and the rest of the straws are set in position.
Figure 18B:
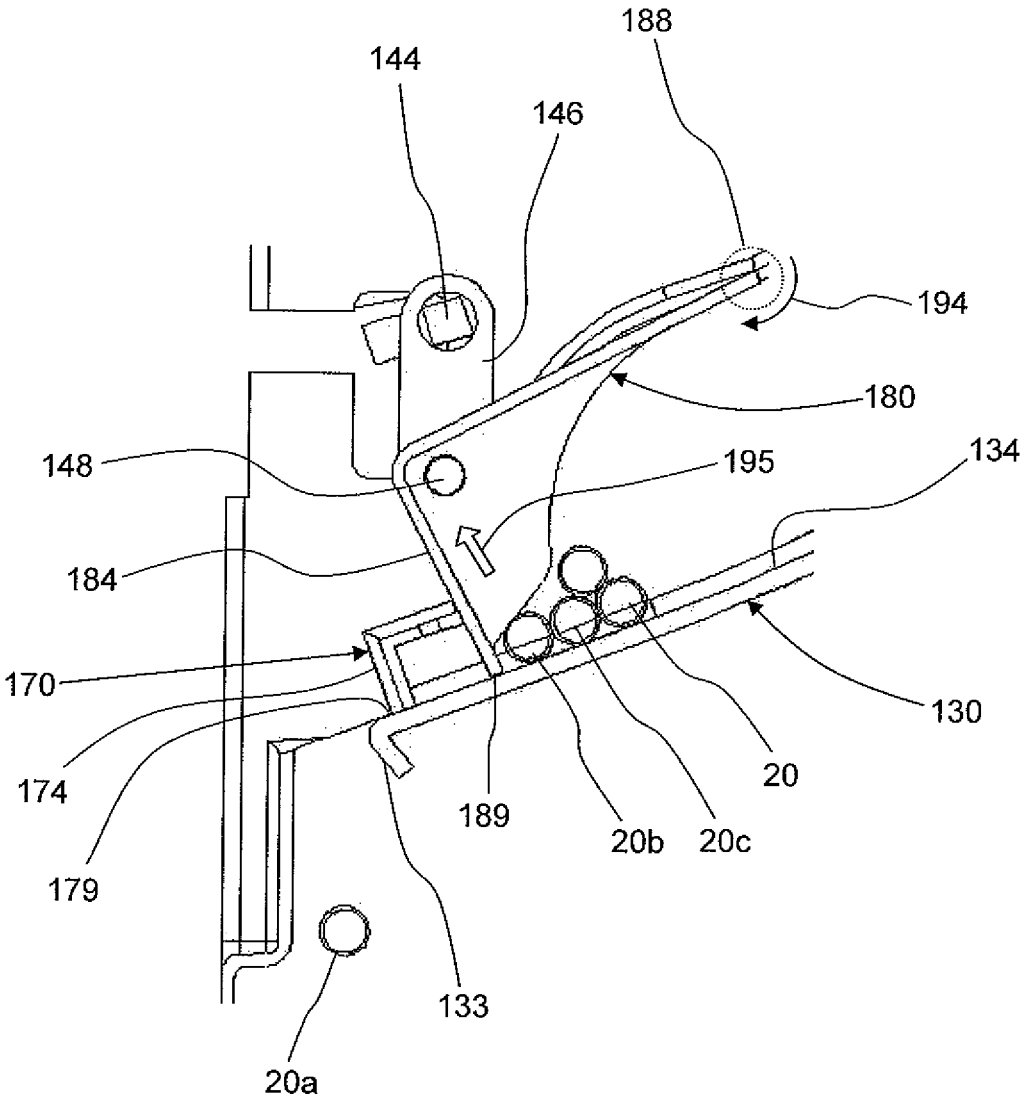
FIG. 18*b* is a side view of the straw releasing mechanism, in the state as generally shown in FIG. 18*a*.

Reference is now made to FIGS. 18*a*, which is a magnified perspective view of the straw releasing mechanism of dispensing sipping straws 100, generally delimited by window "F" shown in FIG. 12, wherein isolated straw 20*a* is still dropping and the rest of the straws 20 are set in position; and to FIG. 18*b*, which is a side view of the straw releasing mechanism, in the state as generally shown in FIG. 18*a*. As shaft 145 rotates further, eccentric portion 144 continues to moves in direction having an upwardly vector as well as a vector away from the inside of straw container 120, pushing connecting bars 146 and thereby moving axis 148 in a general upwardly direction 195. A biasing force (not shown) returns isolator 184 in direction 195, as straw manipulator 180 pivots about axis 188, in direction 194. As isolator 184 moves in direction 195, blade 189 is pushed back by inner surface 134 of moving and feeding member 130 in direction 195, thereby closing back gap 135 between flat edge 179 of end panel 174 of straw leading member 170 and inner surface 134. As isolator 184 moves also in the direction away from the inside of straw container 120, isolator 184 slides over inner surface 134 and the rest of straws 20, leaning on inner surface 183 (see FIG. 9*b*) of isolator 184 by the gravity force, roll back towards the inner surface 173 (see FIG. 6) of end panel 174.

Figure 19A:
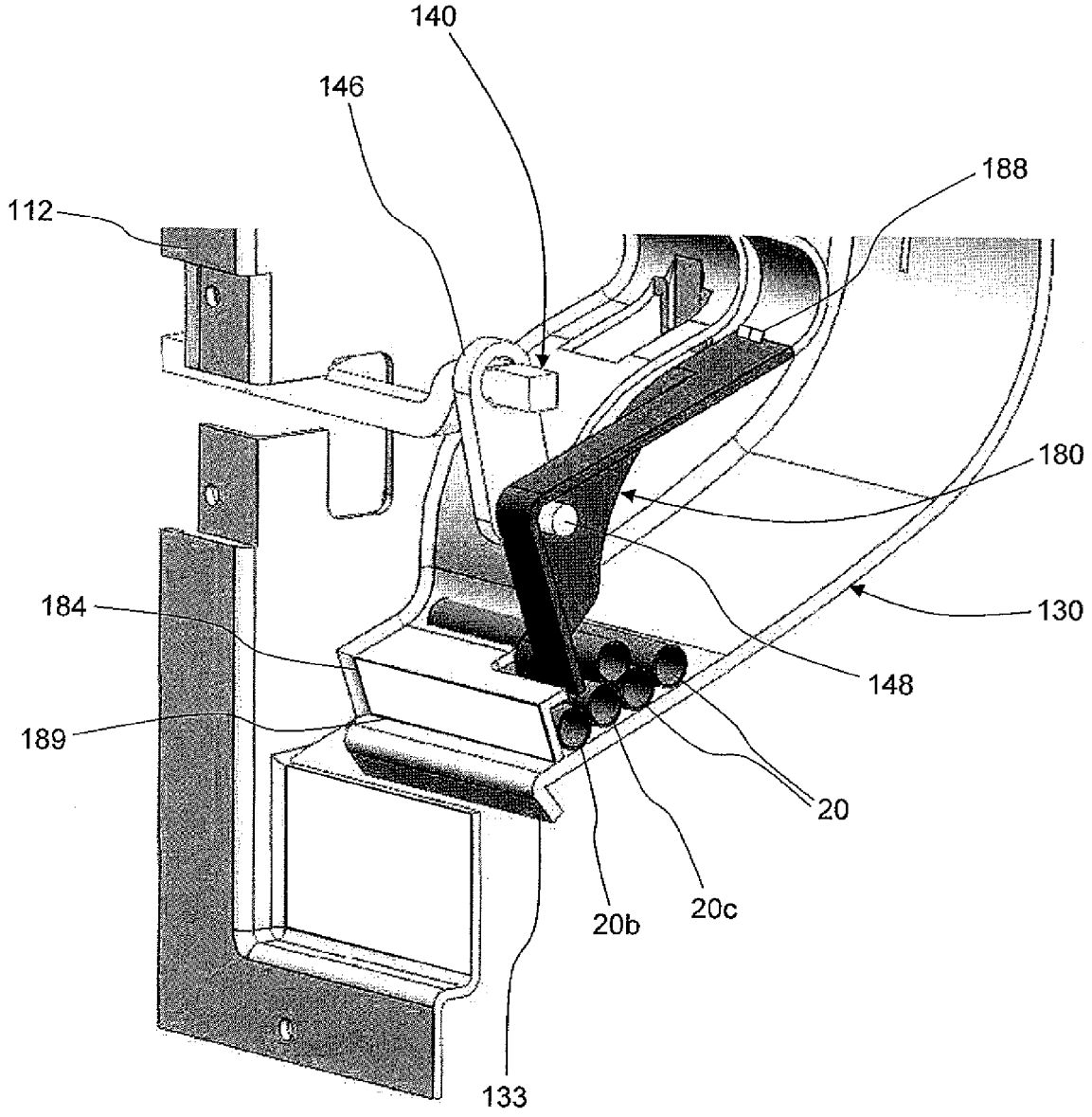
FIG. 19*a* is a magnified perspective view of the straw releasing mechanism, generally delimited by window "F" shown in FIG. 12, wherein the apparatus for dispensing sipping straws returns to the idle state.
Figure 19B:
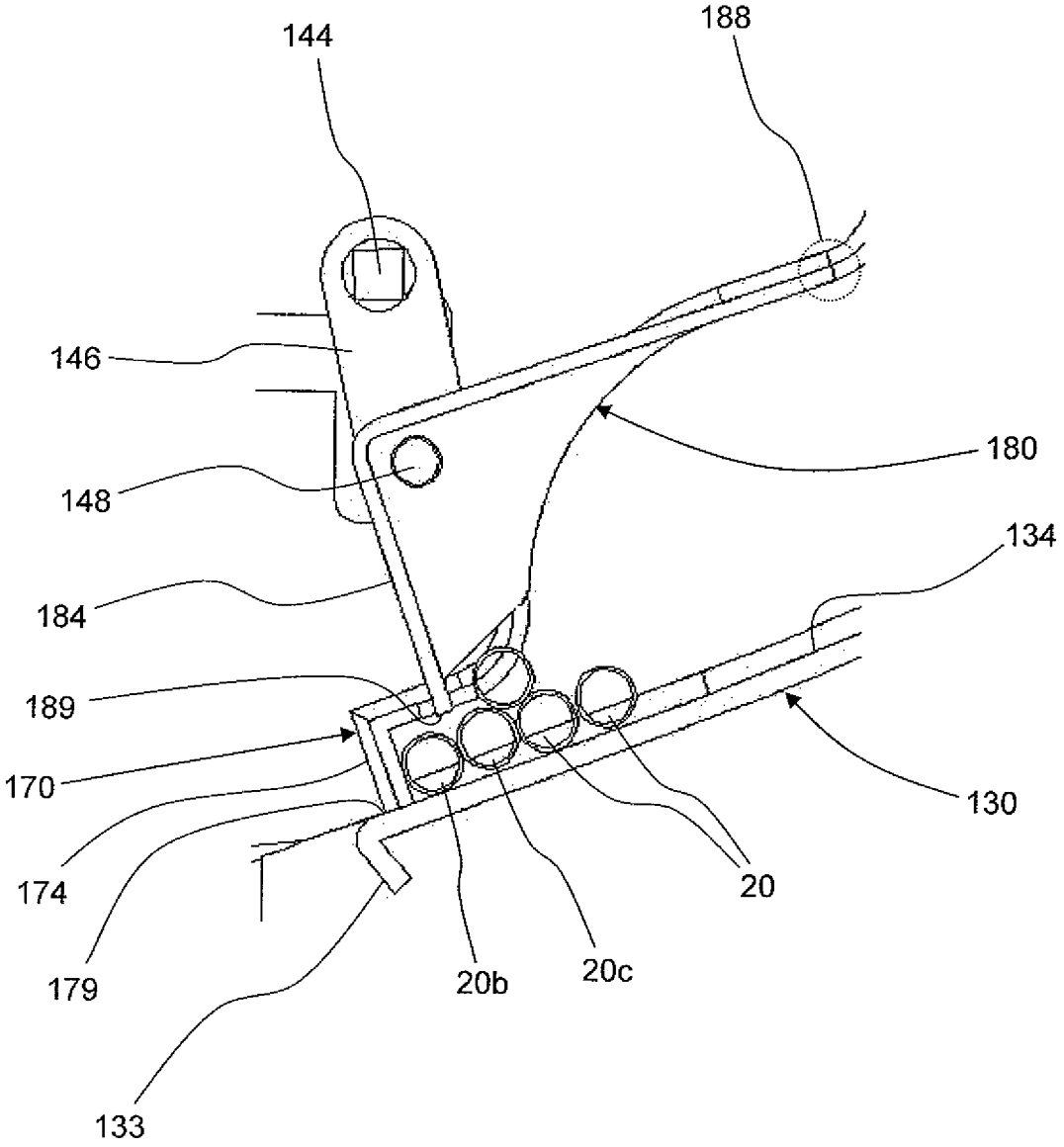
FIG. 19*b* is a side view of the straw releasing mechanism, in the state as generally shown in FIG. 19*a*.

Reference is now made to FIGS. 19*a*, which is a magnified perspective view of the straw releasing mechanism of the apparatus for dispensing sipping straws 100, generally delimited by window "F" shown in FIG. 12, wherein the straw releasing mechanism of apparatus for dispensing sipping straws 100 returns to idle state; and to FIG. 19*b*, which is a side view of the straw releasing mechanism, in the state as generally shown in FIG. 19*a*. Straw manipulator 180 returns to a position above the first layer of straws (including 20*b* and

20*c*), which layer is disposed on inner surface 134 of moving and feeding member 130. Inner surface 134 of moving and feeding member 130 remains adjacent to flat edge 179 of end panel 174 of straw leading member 170. Thereby, the first layer of straws is leaning against the inner surface 173 (see FIG. 6) of end panel 174, which panel 174 prevents from the straws from rolling out of straw container 120.

The straw dispensing cycle is now completed and the apparatus for dispensing sipping straws 100 returns to an idle state, waiting for the next request to dispense a single straw 20, wherein the next straw to be dispensed is now straw 20*b*.

Crank assembly 140 is designated to provide straw manipulator 180 with the powered pivotal motion. It should be noted that crank assembly 140 can be replaced by other powered motion providing mechanisms known in the art, such as pneumatic or hydraulic mechanisms based mechanism, a jackscrew based mechanism or any other such mechanism, all of which are within the scope of the present invention.

In variations of the present invention, the straw manipulator 180 does not include crank assembly 140, but is operated manually by a user. Straw manipulator 180 is pushed down by the user, for example by using an external manual button (not shown), and returns by a biasing force such as a spring.

Figures 20A, 20B:
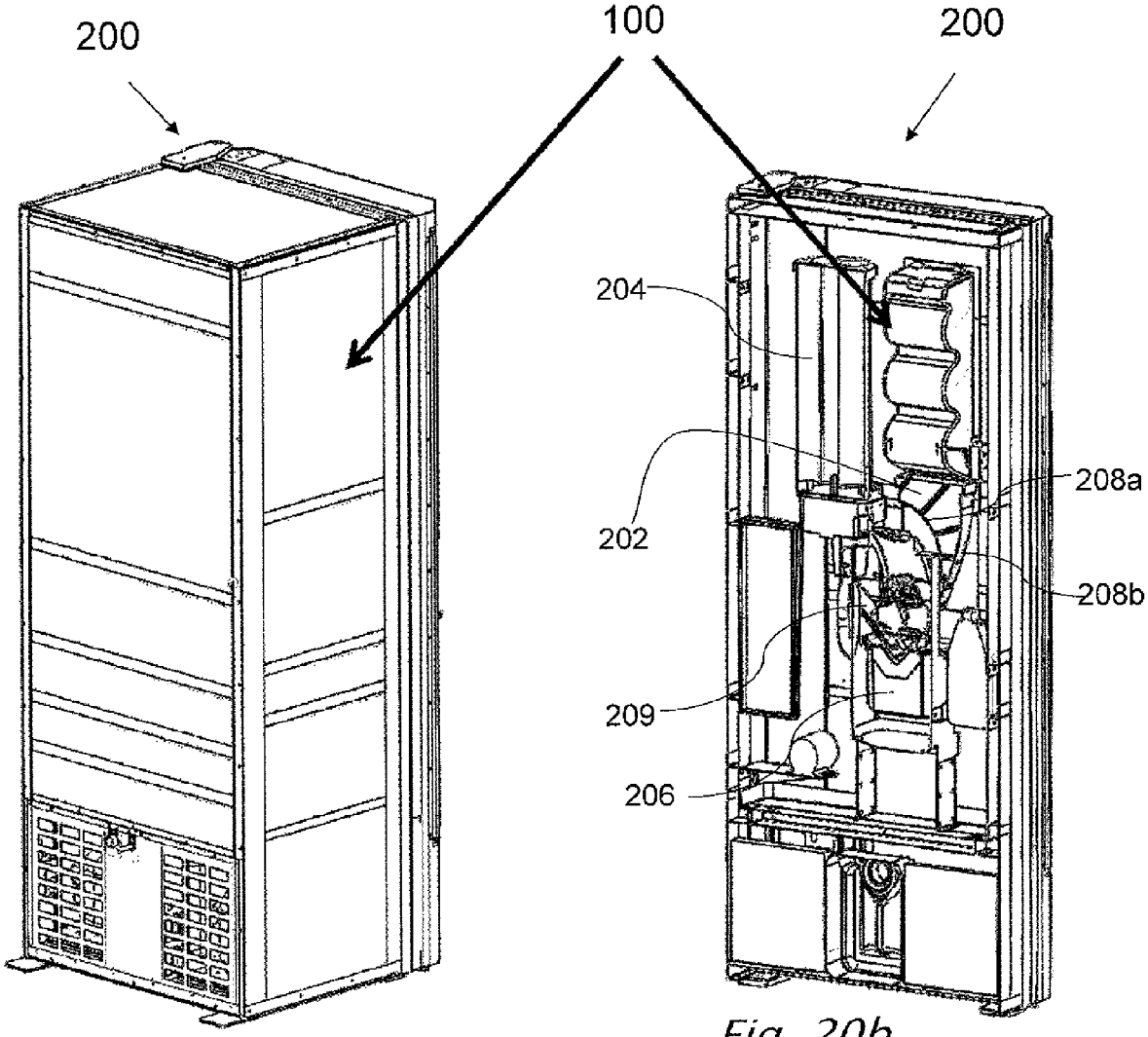
FIG. 20*a* is a back isometric view of a vending machine incorporating the apparatus for dispensing elongated articles.
FIG. 20*b* is a back isometric view of a vending machine of FIG. 20*a* with the back panel disappeared.

Reference is now made to FIGS. 20*a* and 20*b*. FIG. 20*a* is a back isometric view of a vending machine incorporating apparatus 100 for dispensing elongated articles according to some embodiments of the invention and FIG. 20*b* is a back isometric view of the same vending machine with the back panel disappeared. Vending machine 200 may dispense articles such as, but not limited to: fluid beverages, at least partially frozen fluid beverages, liquids such as juice, fruit juice, milk, yogurt, alcoholic beverage or any other drinkable liquid, prepackaged meals, closed beverage containers. If vending machine 200 is a payment-operated vending machine, a containing vessel such as a cup is dropped at a predetermined location and the fluid beverages are dispensed into the cup. For viscous fluids such as yogurt or partially frozen beverages such frozen yogurt, ice coffee, Slurpees® and the like it is preferable to dispense a drinking straw together with the beverage. It is even more preferable that a sipping straw be dispensed into the cup prior to the beverage being dispensed into the cup so that the consumer is presented with a ready-to-consume product without the need for a separately dispensing a straw. The viscosity of the aforementioned beverages precludes the dispensing of a straw into the cup after the beverage has been added and therefore the straw must be dispensed first. Dispensing apparatus 100 can be seen in FIG. 20*b*. A cup is dispensed from vessel dispenser 204 to gravitationally land in cup station 206, via cup chute 209. When a straw is then dispensed from dispensing apparatus 100, the single straw drops into chute 202 which has curved walls 208*a* and 208*b* that are designed to ensure that the horizontally dispensed straw falls substantially vertically into the dispensed cup. The structure of chute 202 ensures that each straw dispensed from dispensing apparatus 100 will land in the substantially same place in cup station 206 (i.e. in the cup) and will have substantially the same orientation (in the cup) each time. After the straw is dispensed, the selected contents can be added to the cup.

While the aforementioned vending machine has been described exemplarily with regards to dispensing a straw and a beverage, it is understood that the scope of the invention includes other dispensed contents and articles, such as, but not limited to, prepackaged meals such as Chinese take-out meals, dispensed synchronously with a single or pair of chopsticks, closed beverage containers such as soda cans, dispensed with a straw and the like. In other variations of the present invention, apparatus 100 for dispensing elongated articles is a standalone apparatus, and not part of a vending machine.

The invention being thus described in terms of embodiments and examples, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An apparatus for dispensing elongated articles, comprising:

(a) a container for holding the elongated articles;

(b) a hopper composed from an elastic material, wherein said hopper is operationally coupled to said container to receive at least a portion of the elongated articles, wherein said hopper is reversibly movable between a closed state and an open state and wherein said hopper pivots about a first axis; and (c) a manipulator for performing a cycle to release a single one of said elongated articles, said manipulator about a second axis, wherein the apparatus is configured to move said manipulator cyclically through a sequence of states including:

(i) an idle state, wherein said manipulator is positioned above a single layer of elongated articles resting on an inner surface of said elastic hopper;

(ii) an isolating state, wherein an isolating blade of said manipulator comes to rest on said inner surface of said elastic hopper between a first elongated article and a second elongated article, thereby isolating said first elongated article; and (iii) a dispensing state, wherein a force exerted by said isolating blade biases said hopper from said closed state to said open state, whereby a gravity force causes said isolated single elongated article to be dispensed from the apparatus, and said hopper elastically returning to said closed state when said force is no longer exerted.

2. The apparatus of claim 1, wherein said container is shaped to retain the elongated articles in a mutually parallel orientation.

3. The apparatus of claim 1, wherein said manipulator is actuated by a crank assembly.

4. The apparatus of claim 3, wherein said crank assembly is rotatably activated by a motor.

5. The apparatus of claim 3, wherein said manipulator is manually activated.

6. The apparatus of claim 1, wherein the apparatus for dispensing the elongated articles is a gravity feed dispensing apparatus.

7. The apparatus of claim 1, wherein said manipulator is a substantially L-shaped device including:

(i) a body portion pivotally attached to said container; and (ii) an isolator, said isolator being substantially perpendicular to said body portion, wherein said isolator is oriented substantially perpendicular to a single layer of the elongated articles, when the elongated articles are at rest in said hopper, so that when actuated, said isolator comes to rest between a first elongated article and a second elongated article, thereby isolating said first elongated article.

8. A vending machine comprising the apparatus of claim 1.

9. The vending machine of claim 8, wherein the vending machine is configured to dispense articles selected from the group including: fluid beverages, at least partially frozen fluid beverages, prepackaged meals, closed beverage containers.

10. The vending machine of claim 8, said vending machine is configured so that said dispensed single elongated article repeatably falls in a substantially similar position.

11. The vending machine of claim 8, wherein said vending machine is configured so that said released single elongated article repeatably falls into a cup station prior to said vending machine dispensing a pre-selected product.

* * * * *